US010337784B2

(12) United States Patent
Mills et al.

(10) Patent No.: US 10,337,784 B2
(45) Date of Patent: Jul. 2, 2019

(54) PHASE CHANGE MATERIAL (PCM) BELTS

(71) Applicant: DOUBLEDAY ACQUISITIONS LLC, Dayton, OH (US)

(72) Inventors: Scott T. Mills, Kettering, OH (US); Ricky J. Lenhard, Centerville, OH (US); Steven R. Eakins, Troy, OH (US)

(73) Assignee: DOUBLEDAY ACQUISITIONS LLC, Dayton, OH (US)

( * ) Notice: Subject to any disclaimer, the term of this patent is extended or adjusted under 35 U.S.C. 154(b) by 438 days.

(21) Appl. No.: 14/184,016

(22) Filed: Feb. 19, 2014

(65) Prior Publication Data

US 2014/0311170 A1 Oct. 23, 2014

Related U.S. Application Data

(60) Provisional application No. 61/766,802, filed on Feb. 20, 2013.

(51) Int. Cl.
*F25D 3/08* (2006.01)
*F25D 11/00* (2006.01)

(52) U.S. Cl.
CPC ..... *F25D 11/003* (2013.01); *F25D 3/08* (2013.01); *F25D 2303/082* (2013.01);
(Continued)

(58) Field of Classification Search
CPC . F25D 11/003; F25D 3/06; F25D 3/08; F25D 2303/082; F25D 2303/02881;
(Continued)

(56) References Cited

U.S. PATENT DOCUMENTS 4,311,022 A * 1/1982 Hall ..... A45C 11/20 62/372
5,187,947 A 2/1993 Breunig et al.
5,483,799 A 1/1996 Dalto
(Continued)

FOREIGN PATENT DOCUMENTS

EP 2 374 443 A1 10/2011
GB 2 394 527 A 4/2004
(Continued)

OTHER PUBLICATIONS

European Search Report and Written Opinion dated Apr. 16, 2015 for Application No. EP 14156021.9, 7 pgs.
U.S. Appl. No. 60/447,987, filed Feb. 17, 2003.

*Primary Examiner* — Elizabeth J Martin
(74) *Attorney, Agent, or Firm* — Frost Brown Todd LLC

(57) ABSTRACT

A container assembly for controlling the thermal condition of cargo includes an insulated container having a cover and a pair of belt assemblies having a plurality of pouches. The container may comprise handles and/or a detachable and/or adjustable shoulder strap. The container assembly further includes a plurality of phase-changing material packs configured to provide for the control of the temperature of cargo contained within the container. The phase-changing material packs are positioned within the belt assemblies and are thermally conditioned prior to use. The belt assemblies may be made of a durable material and may be configured to provide for the expedient exchange of thermal energy between the phase-changing material packs and an exterior of the belt assemblies. The belt assemblies may comprise features that provide for the efficient orienting of the belt assemblies within the container and/or the appropriate selection of phase-changing material packs for a respective belt assembly.

17 Claims, 12 Drawing Sheets

(52) U.S. Cl.
CPC ..... *F25D 2303/085* (2013.01); *F25D 2303/0843* (2013.01); *F25D 2303/08221* (2013.01)

(58) Field of Classification Search
CPC ..... F25D 2303/0843; F25D 2303/0821; F25D 2303/0885; F25D 2303/085
See application file for complete search history.

(56) References Cited

U.S. PATENT DOCUMENTS 5,570,588 A * 11/1996 Lowe ..... B65D 81/3818 62/457.7
5,603,220 A 2/1997 Seaman
5,934,100 A * 8/1999 Hornick ..... B65D 81/3883 62/371
5,943,876 A 8/1999 Meyer et al.
5,950,450 A 9/1999 Meyer et al.
6,860,115 B2 3/2005 Norelius et al.
7,913,511 B2 3/2011 Meyer et al.
2004/0151851 A1* 8/2004 Miller ..... B65D 81/18 428/34.2
2004/0226309 A1 11/2004 Broussard
2010/0314397 A1* 12/2010 Williams ..... B65D 81/3823 220/592.01
2011/0248038 A1* 10/2011 Mayer ..... B65D 81/382 220/592.27

FOREIGN PATENT DOCUMENTS

GB 2394527 A * 4/2004 ..... F25D 3/08
WO WO 2006/123931 A2 11/2006
WO WO 2012/094333 A1 7/2012

* cited by examiner

PHASE CHANGE MATERIAL (PCM) BELTS

PRIORITY

This application claims priority to U.S. Provisional Pat. Appl'n. No. 61/766,802, entitled "Phase Change Material (PCM) Belts," filed Feb. 20, 2013, the disclosure of which is incorporated by reference herein.

BACKGROUND

In the transporting or shipment of temperature sensitive materials or items such as blood, plasma, vaccines and certain drugs, it is known to use insulated containers which include heating and/or cooling means as disclosed, for example in U.S. Pat. No. 7,913,511, entitled "Cargo Container for Transporting Temperature Sensitive Items", and issued Mar. 29, 2011; in U.S. Pat. No. 5,950,450, entitled "Containment System for Transporting and Storing Temperature-Sensitive Materials", and issued Sep. 14, 1999; in U.S. Pat. No. 5,943,876, entitled "Insulating Vacuum Panel, Use of Such Panel as Insulating Media and Insulated Containers Employing Such Panel", and issued Aug. 31, 1999; in U.S. Pat. No. 5,483,799, entitled "Temperature Regulated Specimen Transporter", and issued Jan. 16, 1996; and in U.S. Pat. No. 5,603,220, entitled "Electronically Controlled Container for Storing Temperature Sensitive Material", and issued Feb. 18, 1997; the disclosures of which are incorporated by reference herein. When it is desirable to transport or ship a larger volume of temperature sensitive items, it is desirable to provide a cargo container which is adapted to receive a pallet supporting the temperature sensitive items and which also includes cooling and/or heating means for maintaining the temperature sensitive items within a close predetermined temperature range. Such cargo containers are disclosed, for example, in U.S. Pat. No. 5,187,947, entitled "Wheel Type Freezer and Method for Rapid, Low Temperature Freezing", and issued Feb. 23, 1993; and U.S. Pat. No. 6,860,115, entitled "Air-Cargo Container, a Refrigerator Unit for an Air-Cargo Container and a Manufacturing Method of an Air-Cargo Container", and issued Mar. 1, 2005; and in a publication of applicants entitled AcuTemp™ Thermal Pallet Shipper; the disclosures of which are incorporated by reference herein. A Temperature-Controlled, Pallet-Sized Shipping Container is also disclosed in U.S. Pat. Pub. No. 2004/0226309, published Nov. 18, 2004, and the disclosure of which is herein incorporated by reference. This published application claims the benefit of U.S. Provisional Pat. Appl'n. No. 60/447,987, filed Feb. 17, 2003, and the disclosure of which is incorporated by reference herein.

The temperature sensitive materials or items may be wrapped in a support material during shipment. Such support material may be used to keep the temperature sensitive materials or items on the pallets during shipment. Nevertheless, the support material does not typically provide adequate insulation, and the temperature sensitive materials or items may take on the ambient temperature of the cargo container. The temperature of the cargo unit can significantly fluctuate due to the higher temperatures during the day and the lower temperatures at night or as a result of differing temperatures of various locations and/or elevations during transport and distribution. As a result, the temperature sensitive materials or items are exposed to the fluctuating temperatures of the cargo container, which can adversely affect the temperature sensitive materials or items during storage, transport, and/or distribution. It may therefore be desirable to provide a support material comprising phase-changing materials ("PCM") to thereby maintain a more constant temperature within the temperature sensitive materials or items.

A PCM is a substance with a high heat of fusion which, by melting and solidifying at a particular temperature, is capable of storing and releasing significant amounts of energy while maintaining a nearly constant temperature. Heat is absorbed or released as the PCM changes from solid to liquid and vice versa; thus, PCMs are classified as latent heat storage units. In particular, when an external temperature rises, heat is absorbed by the PCM as the PCM changes from solid to liquid to thereby have a cooling effect upon items close to or contacting the PCM; whereas when the external temperature drops, heat is released by the PCM as the PCM changes from liquid to solid to thereby have a heating effect upon items close to or contacting the PCM. The internal temperature of the PCM, however, remains nearly constant as the PCM changes from solid to liquid and vice versa, which is useful for keeping temperature sensitive materials or items at a uniform temperature. A user may "condition" a PCM by heating, cooling, and/or freezing the PCM prior to use to thereby place the PCM in a condition to absorb or release heat at a predetermined/estimated temperature. Some commonly used PCMs include: salt hydrates, paraffin wax, fatty acids, and esters.

PCM packs are generally packaged in individual rigid plastic bottles or flexible plastic pouches. The rigid plastic bottles and flexible plastic pouches typically have no secondary layer of protection and may crack, tear, or become worn upon repeated use thereby causing leakage of the PCM. Therefore, in any cargo container adapted to receive one or more pallets of temperature sensitive materials or items, it may be desirable to provide PCM packs that are durable enough to withstand the inherent hazards of use such as rips, tears, abrasions, etc. It may also be desirable to provide features that allow for simple and efficient packing and/or orientation of the PCM packs within the cargo container. Furthermore, when rigid plastic bottles and/or flexible plastic pouches are used, these types of PCM packs typically require a large quantity of individual packs in order to achieve sufficient product coverage within the cargo container. Thus it may further be desirable to provide features that allow for sufficient coverage of the temperature sensitive materials or items within the cargo container while using the least number of PCM packs possible.

PCM packs that are required to maintain product temperatures within an upper and lower temperature limit will generally include at least two PCMs with different melting and/or boiling points. A first PCM pack will be conditioned in a solid state and will thaw during use to prevent temperatures from exceeding the high end of the temperature range. A second PCM pack will be conditioned in a liquid state and will freeze during use to prevent temperatures from exceeding the low end of the temperature range. For example, a first PCM pack having a freeze point of 0° C. (32° F.) may be conditioned at −20° C. (−4° F.) such that the first PCM pack is in a solid state prior to use in a 2-8° C. (35.6-46.4° F.) environment, while a second PCM pack having a freeze point of 3° C. (37.4° F.) may be conditioned at 5° C. (41° F.) such that the second PCM pack is in a liquid state prior to use in the 2-8° C. (35.6-46.4° F.) environment. A pouch may be provided that is designed to receive multiple PCM packs in those instances where a single conditioning temperature will result in a solid state for a first PCM pack and a liquid state for a second PCM pack. For example, a first PCM pack with a freeze point of 3° C. (37.4° F.) and a second PCM pack with a freeze point of 18° C.

(64.4° F.) may be concurrently conditioned at 5° C. (41° F.) prior to use in a 2-25° C. (35.6-77° F.) environment such that the first PCM pack is in a liquid state and such that the second PCM pack is in a solid state.

SUMMARY

A belt has one or more pouches comprising a durable material (e.g. nylon, etc.) and is operable to be filled with one or more PCM packs. In one embodiment, the belt comprises one long pouch operable to be filled with a plurality of PCM packs. In another embodiment, the belt comprises a plurality of pouches operable to each be filled with a single PCM pack. The pouches of the above-mentioned belts may include a flap operable to cover a respective opening of each pouch to thereby prevent intentional and/or unintentional removal of a respective PCM pack positioned therein. Such a flap may be selectively opened and closed or fixedly secured to a respective pouch to cover and/or uncover an opening of the pouch. For instance, the flap may be sewn to cover the opening of the pouch after the PCM pack is inserted therein; on the other hand, the flap may selectively cover or uncover the opening of the pouch after the PCM pack is inserted therein via Velcro, a zipper, a button(s), etc. Other features and advantages of the invention will be apparent from the following description, the accompanying drawings and the appended claims.

BRIEF DESCRIPTION OF THE DRAWINGS

While the specification concludes with claims which particularly point out and distinctly claim this technology, it is believed this technology will be better understood from the following description of certain examples taken in conjunction with the accompanying drawings, in which like reference numerals identify the same elements and in which:

FIG. 8B, the second belt of FIG. 8C, and the cargo of FIG. 8D positioned within the interior cavity of the cargo, and with a cover positioned within the interior cavity of the container atop the first belt, the second belt, and the cargo;

Figure 1:
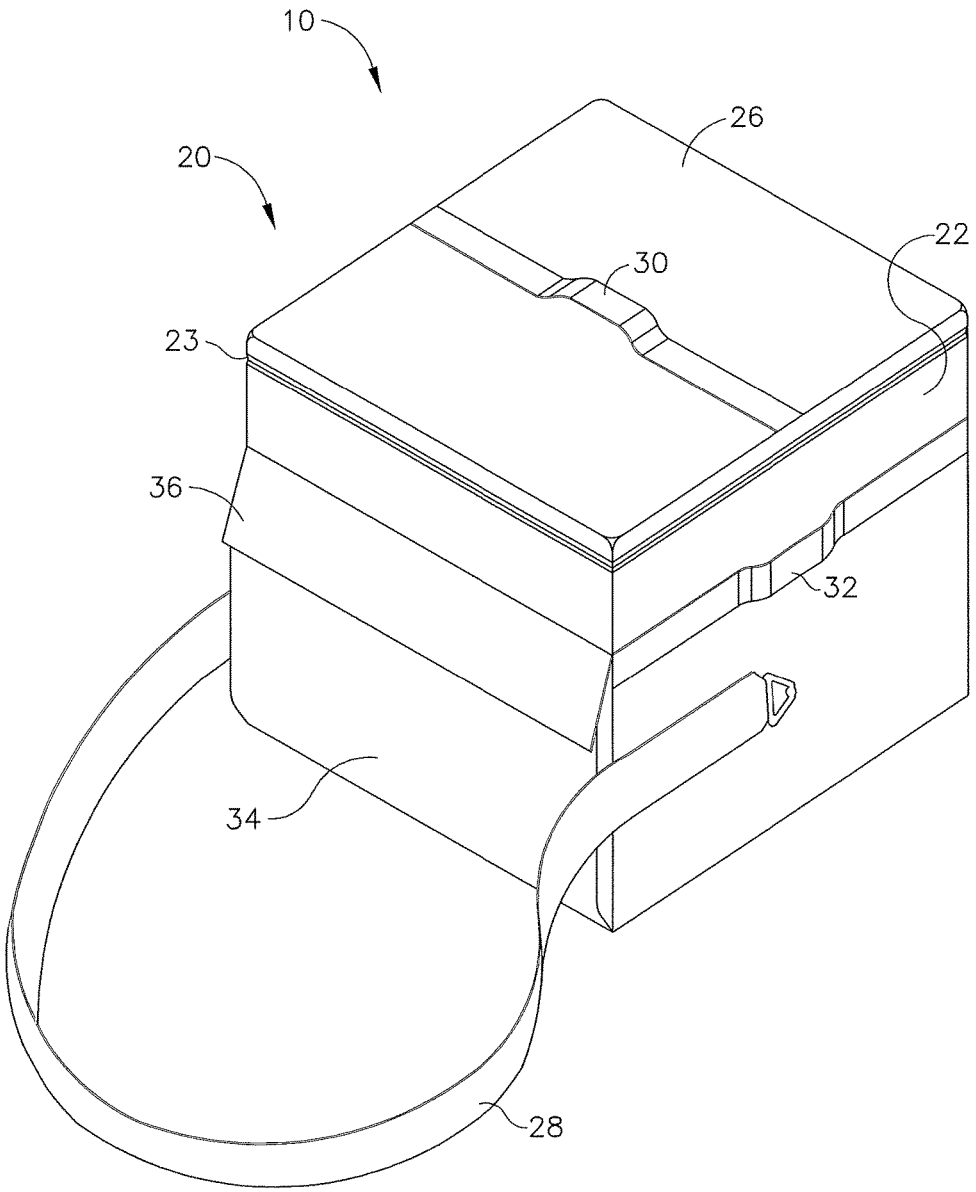
FIG. 1 depicts a perspective view of an exemplary temperature-controlled cargo container assembly.

The drawings are not intended to be limiting in any way, and it is contemplated that various embodiments of the technology may be carried out in a variety of other ways, including those not necessarily depicted in the drawings. The accompanying drawings incorporated in and forming a part of the specification illustrate several aspects of the present technology, and together with the description serve to explain the principles of the technology; it being understood, however, that this technology is not limited to the precise arrangements shown.

DETAILED DESCRIPTION

The following description of certain examples of the technology should not be used to limit its scope. Other examples, features, aspects, embodiments, and advantages of the technology will become apparent to those skilled in the art from the following description. As will be realized, the technology described herein is capable of other different and obvious aspects, all without departing from the technology. Accordingly, the drawings and descriptions should be regarded as illustrative in nature and not restrictive.

It is further understood that any one or more of the teachings, expressions, embodiments, examples, etc. described herein may be combined with any one or more of the other teachings, expressions, embodiments, examples, etc. that are described herein. The following-described teachings, expressions, embodiments, examples, etc. should therefore not be viewed in isolation relative to each other. Various suitable ways in which the teachings herein may be combined will be readily apparent to those of ordinary skill in the art in view of the teachings herein. Such modifications and variations are intended to be included within the scope of the claims.

I. Exemplary Temperature-Controlled Cargo Container

Figure 2:
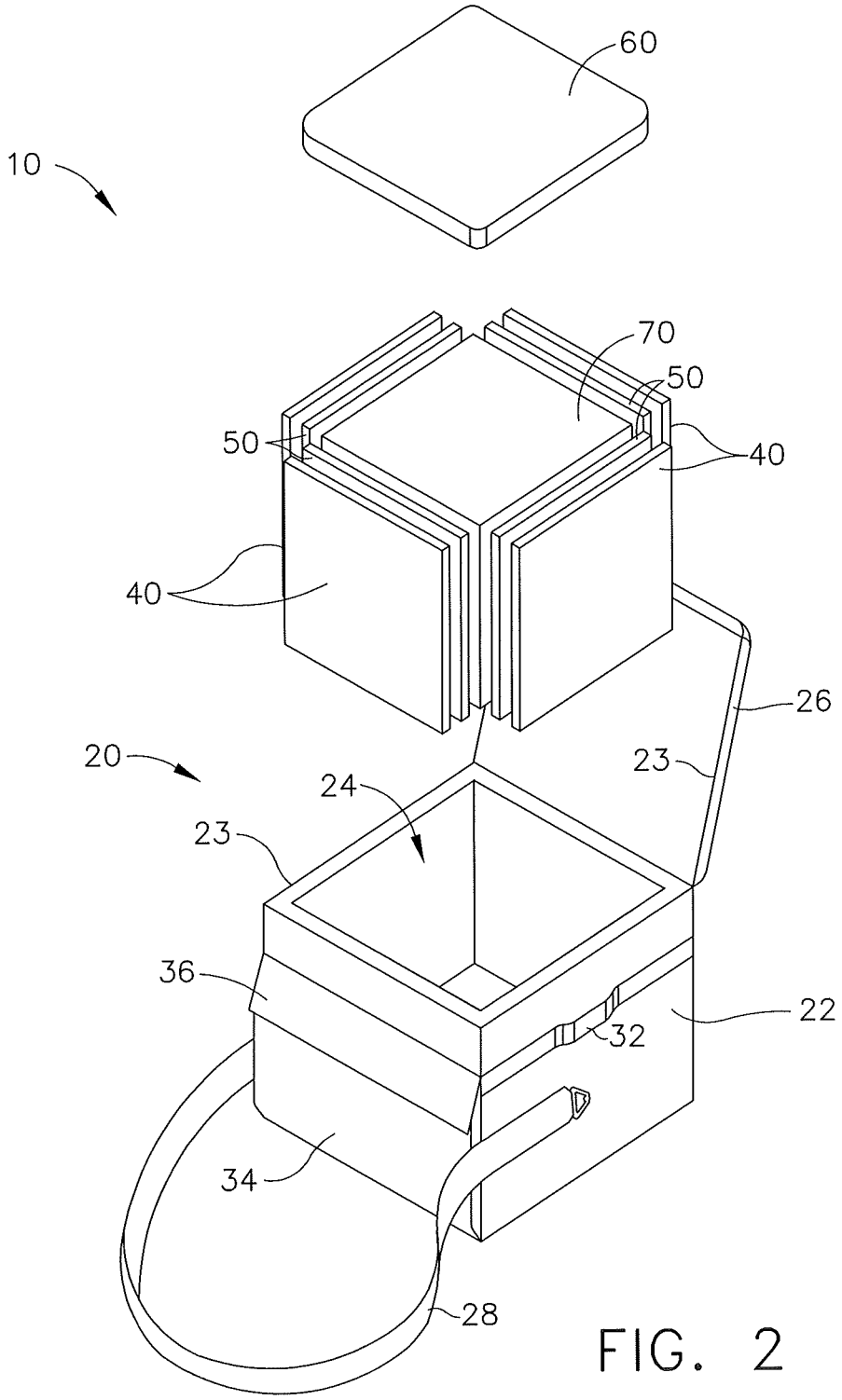
FIG. 2 depicts an exploded perspective view of the container assembly of FIG. 1.

FIGS. 1 and 2 illustrate an exemplary temperature-controlled cargo container assembly (10). At least part of container assembly (10) may be constructed and operable in accordance with at least some of the teachings of U.S. Pat. Nos. 7,913,511; 5,950,450; 5,943,876; 5,483,799; 5,603,220; 5,187,947; 6,860,115; and/or U.S. Pat. Pub. No. 2004/0226309. The disclosures of each of the foregoing patents and publications are incorporated by reference herein. As described therein and as will be described in greater detail below, container assembly (10) is operable to receive, contain, and control the temperature of temperature sensitive materials or items such as blood, plasma, vaccines and certain drugs during transportation and shipment of such items or materials. It should also be understood that container assembly (10) may have various structural and functional similarities with the CSafe® RKN containers, the CSafe SVS containers, the CSafe AcuTemp AX27L containers, the CSafe AcuTemp AX56L containers, the CSafe AcuTemp Courier containers, the CSafe AcuTemp PX1L containers, or any other the CSafe packing container(s); all available from CSafe Global, 2900 Dryden Road, Dayton, Ohio 45439. Furthermore, container assembly (10) may have various structural and functional similarities with the devices taught in any of the other references that are cited and incorporated by reference herein.

Container assembly (10) of the present example comprises an insulated container (20), a plurality of first PCM packs (40), a plurality of second PCM packs (50), and an insulated cover (60). Container (20) of the present example is insulated using vacuum insulated panel ("VIP"), but may be insulated using any appropriate material. Container (20) of the present example comprises a rectangular-shaped body (22), a lid (26), a padded shoulder strap (28), a plurality of handles (30, 32), and a pouch (34). Body (22) defines a rectangular-shaped hollow interior (24). Lid (26) is hingedly secured to a sidewall of body (22) such that lid (26) is pivotable between a closed position and an open position to thereby selectively cover and/or uncover hollow interior (24) of body (22). Body (22) and lid (26) of container (20) include a zipper (23) configured to secure lid (26) in the closed position. It should be understood, however, that body (22) and lid (26) of container (20) may include any other appropriate type of locking feature(s) configured to secure lid (26) in the closed position. For instance, body (22) and lid (26) may, alternatively or in addition to zipper (23), include Velcro, a plurality of buttons, etc.

Padded shoulder strap (28) is pivotably coupled to an exterior surface of body (22) of container (20). Shoulder strap (28) may be adjustable and may further be detachable from body (22) of container (20). Handles (30, 32) of the present example are secured to an exterior surface of lid (26) and an exterior surface of body (22) respectively. Pouch (34) of the present example is formed on an exterior surface of body (22). Pouch (34) defines a hollow interior and includes a lid (36) hingedly secured to an exterior surface of body (22) such that lid (36) is pivotable between a closed position and an open position to thereby selectively cover and/or uncover the hollow interior of pouch (34).

It should be understood that any of the components of container (20) discussed above, e.g. body (22), lid (26), etc., may comprise a waterproof material. For instance, body (22) and lid (26) may comprise nylon among other appropriate materials. It should also be understood that container (20) may include any or all the features discussed above and may further include any appropriate features configured to provide for efficient transportation. For instance, container (20) may include a pair of wheels and an extendable handle to thereby allow container (20) to operate substantially similar to a rolling suitcase. Furthermore, container (20) may include straps to allow for container (20) to be secured to a rolling cart (not shown).

The plurality of first PCM packs (40) are positioned within hollow interior (24) of body (22) of container (20) about an interior surface of hollow interior (24) to thereby control a temperature of cargo (70) positioned within hollow interior (24). First PCM packs (40) of the present example comprise a flexible film material filled with a freezable-liquid substance having a high heat of fusion capable of storing and releasing large amounts of energy. First PCM packs (40) are frozen prior to being positioned within container (20) to thereby have a thermal controlling effect upon cargo (70) positioned within hollow interior (24). It will be understood from the discussion below that first PCM packs (40) provide a cooling effect upon cargo (70) positioned within hollow interior (24) through a solid-liquid phase change to thereby prevent the temperature of cargo (70) from exceeding an upper temperature limit. As explained above, first PCM packs (40) are frozen prior to use and may thaw during use within container (20) to prevent the temperature of cargo (70) from exceeding a high end of a required temperature range.

The plurality of second PCM packs (50) are positioned within hollow interior (24) of body (22) of container (20) about an interior surface of first PCM packs (40) within hollow interior (24) to thereby control the temperature of cargo (70) positioned within hollow interior (24). Second PCM packs (50) of the present example comprise a flexible film material filled with a liquid substance having a high heat of fusion capable of storing and releasing large amounts of energy. Second PCM packs (50) are configured to be refrigerated prior to being positioned within container (20) to thereby have a thermal controlling effect upon cargo (70) positioned within hollow interior (24). It will be understood from the discussion below that second PCM packs (50) provide a heating effect upon cargo (70) positioned within hollow interior (24) through a liquid-solid phase change to thereby prevent the temperature of cargo (70) from dropping below a lower temperature limit. As mentioned above, second PCM packs (50) are refrigerated prior to use and may freeze during use within container (20) to prevent the temperature of cargo (70) from exceeding a low end of a required temperature range.

As will be discussed in more detail below, with first PCM packs (40) and second PCM packs (50) disposed within hollow interior (24) of body (22) of container (20), first PCM packs (40) and second PCM packs (50) define a rectangular-shaped cavity (27) within hollow interior (24) into which cargo (70) is disposed. With cargo (70) disposed within cavity (27) defined by first PCM packs (40) and second PCM packs (50), cover (60) is positioned within hollow interior (24) atop first PCM packs (40), second PCM packs (50), and cargo (70). Cover (60) of the present example is sized such that cover (60) may be positioned within hollow interior (24) in a substantially horizontal position. Cover (60) of the present example is further sized such that with cover (60) in the substantially horizontal position, cover (60) substantially covers an entire width and length of hollow interior (24). Cover (60) of the present example is insulated using VIP, but may be insulated using any appropriate material.

II. Exemplary Temperature-Controlled Cargo Container Having PCM Belts

As mentioned above, first PCM packs (40) and second PCM packs (50) of container assembly (10) each comprise a flexible film material filled with a liquid substance. It will be appreciated that the film material of first PCM packs (40) and second PCM packs (50) may become worn and rip or tear upon rough or repeated use thereby causing leakage of the liquid substance contained therein. It should therefore be understood that it may be desirable to provide features that improve the durability of first PCM packs (40) and second PCM packs (50) such that first PCM packs (40) and second PCM packs (50) may withstand the inherent hazards of repeated use. FIGS. 3-8F show such features, e.g. belt assemblies (100, 200), configured to improve the durability of first PCM packs (40) and second PCM packs (50) as will be discussed in more detail below. Also as will be discussed in more detail below, belt assemblies (100, 200) comprise features that allow for simple and efficient packing and/or orientation of first PCM packs (40) and second PCM packs (50) within belt assemblies (100, 200) and of belt assemblies (100, 200) within container (20).

Figure 3:
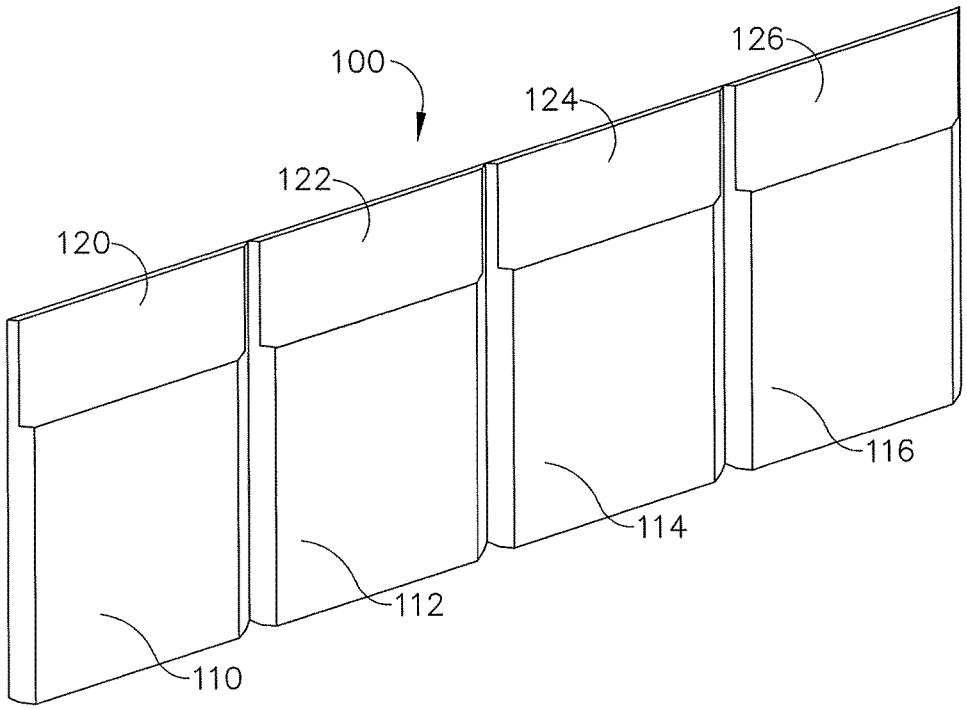
FIG. 3 depicts a perspective view of an exemplary belt having a plurality of pouches configured to receive at least one PCM pack.

FIG. 3 shows a first belt assembly (100). Belt assembly (100) of the present example may comprise any durable material having an appropriate heat transfer coefficient to allow communication of thermal energy between PCM packs (40, 50) and cargo (70) such as nylon, but may comprise any other appropriate material. It should be appreciated that belt assembly (100) may additionally or alternatively comprise a waterproof material or a material which allows for the expedient transfer of thermal energy there through. Belt assembly (100) of the present example comprises a plurality of pouches (110, 112, 114, 116). Pouches (110, 112, 114, 116) are consecutively hingedly secured together in series such that each pouch (110, 112, 114, 116) is operable to pivot toward and away from the other respective pouches (110, 112, 114, 116) to thereby form a plurality of configurations. For instance, and as will be discussed in more detail below, belt assembly (100) may be folded into a square/rectangular-shaped orientation. Each pouch (110, 112, 114, 116) defines a hollow interior configured to receive at least one PCM pack of first PCM packs (40) and/or second PCM packs (50). Each pouch (110, 112, 114, 116) includes a cover (120, 122, 124, 126) configured to selectively cover and/or uncover a respective hollow interior of each pouch (110, 112, 114, 116) to thereby provide access to the hollow interior of each pouch (110, 112, 114, 116) such that at least one PCM pack may be inserted and contained therein. As will be discussed in more detail below, belt assembly (100) may comprise features that allow for simple and efficient packing and/or orientation of first PCM packs (40) and second PCM packs (50) within pouches (110, 112, 114, 116) and of belt assembly (100) within container (20).

Figure 4:
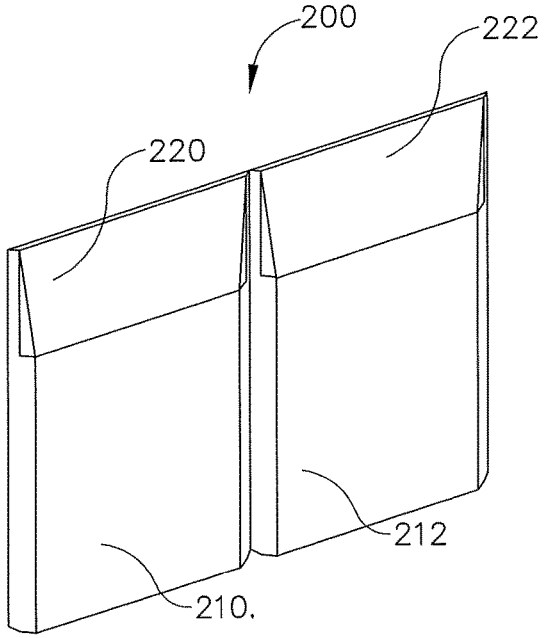
FIG. 4 depicts a perspective view of an exemplary alternative belt having a plurality of pouches configured to receive at least one PCM pack.

Although belt assembly (100) of the present example comprises four pouches (110, 112, 114, 116), it should be understood that belt assembly (100) may comprise any appropriate number of pouches. For instance, FIG. 4 shows a second belt assembly (200) having a pair of pouches (210, 212). Belt assembly (200) of the present example may comprise any durable material having an appropriate heat transfer coefficient to allow communication of thermal energy between PCM packs (40, 50) and cargo (70) such as nylon, but may comprise any other appropriate material. It should be appreciated that belt assembly (200) may additionally or alternatively comprise a waterproof material or a material which allows for the expedient transfer of thermal energy there through. Pouches (210, 212) are hingedly secured together such that each pouch (210, 212) is operable to pivot toward and away from the other to thereby form a plurality of configurations. Each pouch (210, 212) defines a hollow interior configured to receive at least one PCM pack of first PCM packs (40) and/or second PCM packs (50). Each pouch (210, 212) includes a cover (220, 222) configured to selectively cover and/or uncover a respective hollow interior of each pouch (210, 212) to thereby provide access to the hollow interior of each pouch (210, 212) such that at least one PCM pack may be inserted and contained therein. As will be discussed in more detail below, belt assembly (200) may comprise features that allow for simple and efficient packing and/or orientation of first PCM packs (40) and second PCM packs (50) within pouches (210, 212) and of belt assembly (200) within container (20).

Figure 5:
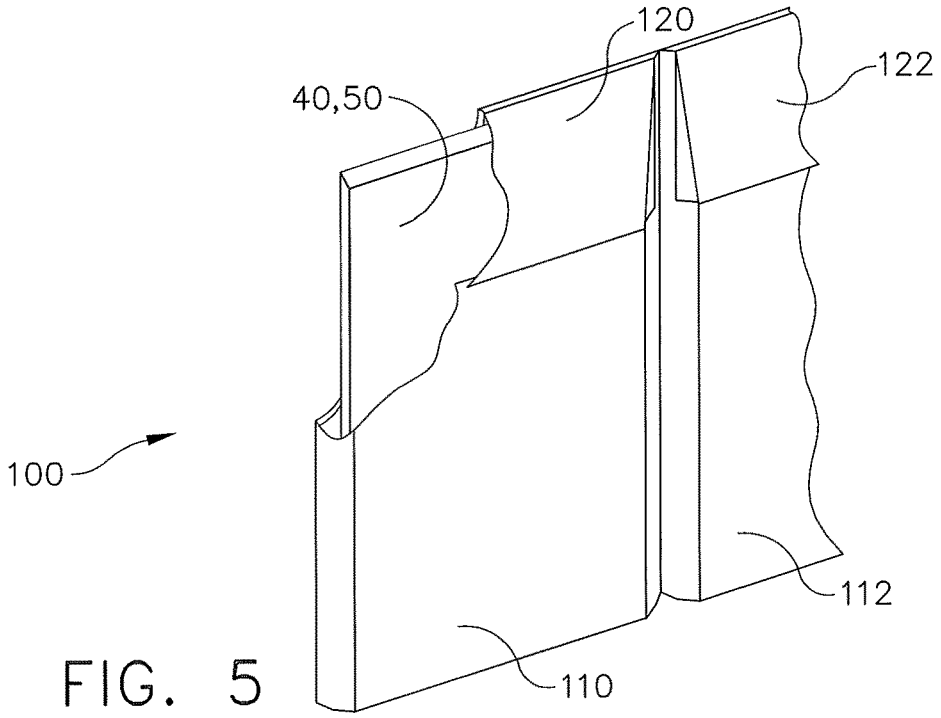
FIG. 5 depicts a partial perspective view of the belt of FIG. 3 with a portion of a pouch cut-away to show a PCM pack disposed therein.
Figure 6:
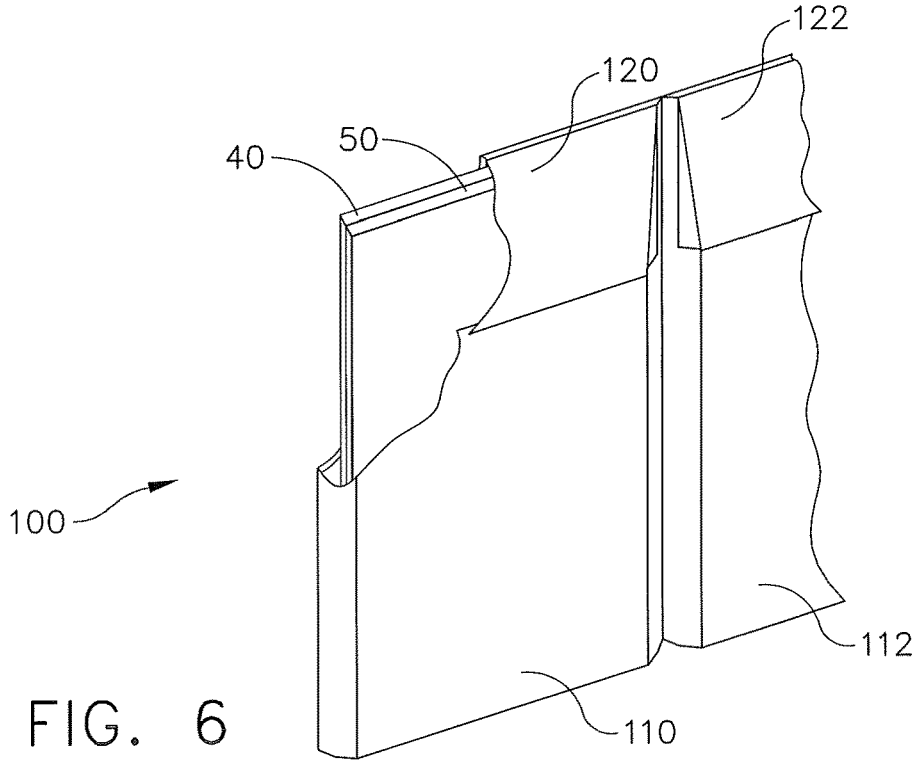
FIG. 6 depicts a partial perspective view of the belt of FIG. 3 with a portion of a pouch cut-away to show a pair of PCM packs disposed therein.

As shown in FIGS. 5 and 6, and as mentioned above, pouches (110, 112, 114, 116) of belt assembly (100) are configured to receive one or more PCM packs (40, 50). For instance, a single PCM pack (40, 50) may each be disposed within the hollow interior of a separate pouch (110) of belt assembly (100) as shown in FIG. 5. Alternatively, a first PCM pack (40) and a second PCM pack (50) may both be disposed within the hollow interior of one pouch (110) of belt assembly (100) as shown in FIG. 6.

Figure 7:
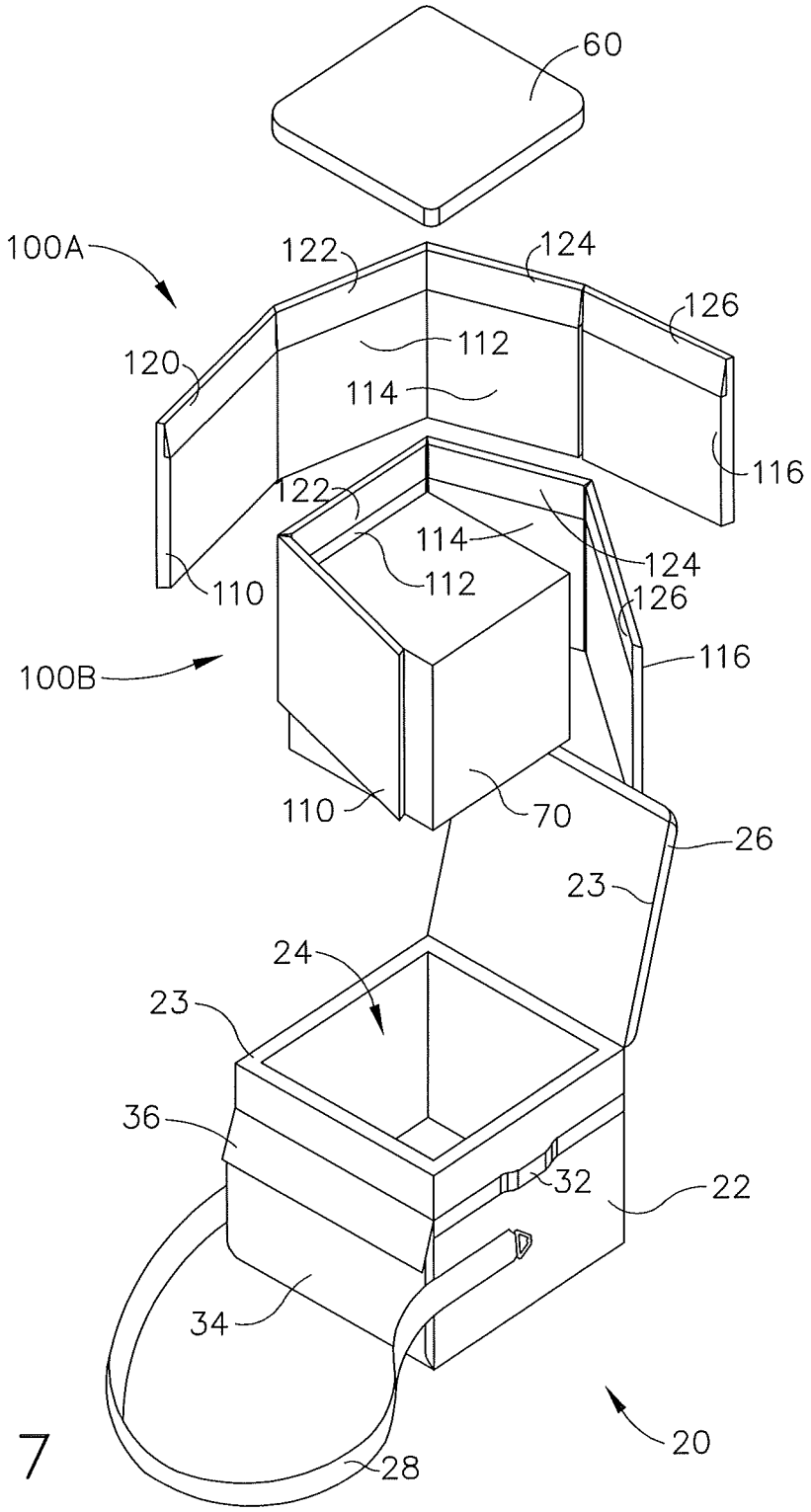
FIG. 7 depicts an exploded perspective view of an exemplary alternative cargo container assembly having a pair of belts, similar to the belt of FIG. 3.

In those versions of belt assembly (100) having a single PCM pack (40, 50) within each pouch (110, 112, 114, 116), it should be understood that multiple belt assemblies (100A, 100B) may be placed within hollow interior (24) of container (20) with each belt assembly (100) housing a different type of PCM pack (40, 50). For instance, as shown in FIG. 7, a first belt assembly (100A) may be provided having first PCM packs (40) disposed within pouches (110, 112, 114, 116) and a second belt assembly (100B) may be provided having second PCM packs (50) disposed within pouches (110, 112, 114, 116). Belt assemblies (100A, 100B) may be oriented within hollow interior (24) of container (20) such that belt assembly (100B) and second PCM packs (50) are more proximal to cargo (70) or alternatively such that belt assembly (100A) and first PCM packs (40) are more proximal to cargo (70). It should be understood that belt assemblies (100A, 100B) may be configured to prevent incorrect orientation of belt assemblies (100A, 100B) within hollow interior (24) of container (20). For instance, belt assembly (100B) may be sized smaller than belt assembly (100A) such that belt assembly (100B) will not fit completely around the exterior of belt assembly (100A) and such that belt assembly (100B) may only be placed within belt assembly (100A). Additionally or alternatively, belt assemblies (100A, 100B) may be color-coded and/or comprise instructions to provide assistance in properly orienting belt assemblies (100A, 100B) within hollow interior (24) of container (20).

Figure 8A:
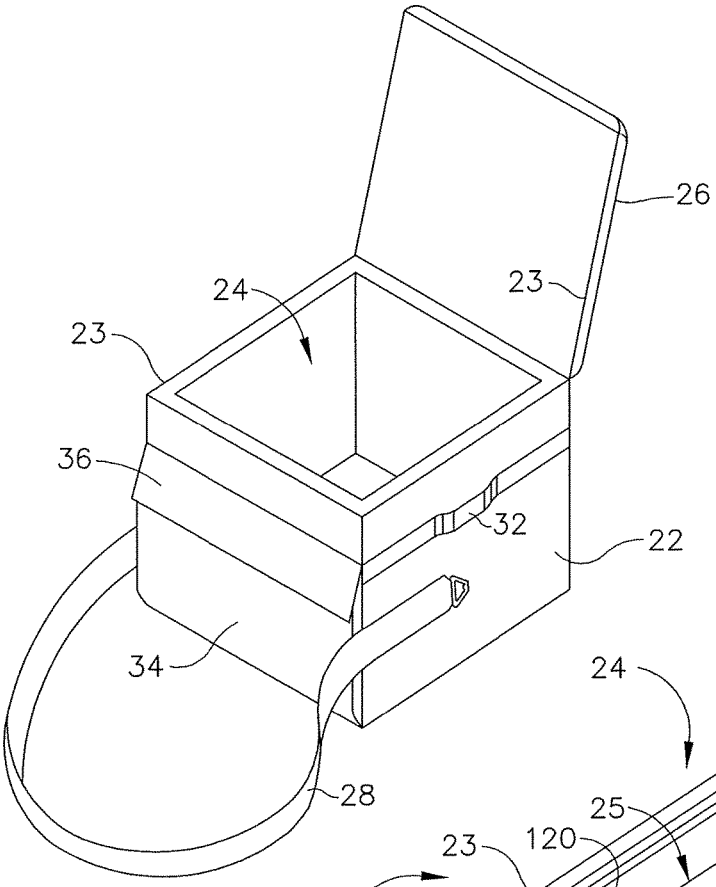
FIG. 8A depicts a perspective view of a container of the cargo container assembly of FIG. 7.
Figure 8B:
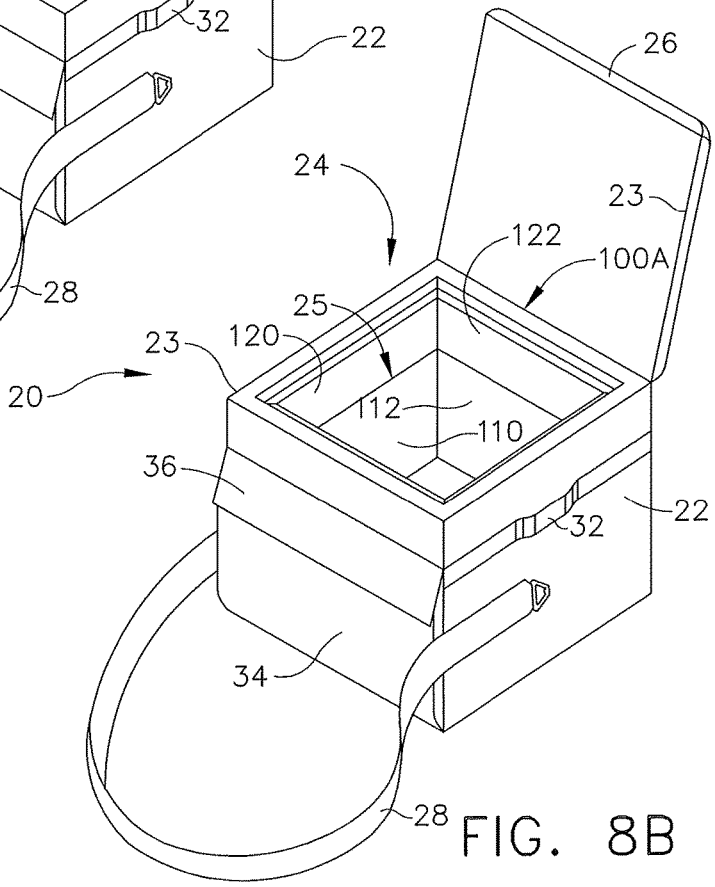
FIG. 8B depicts a perspective view of the container of FIG. 8A with a first belt, similar to the belt of FIG. 3, positioned within an interior cavity of the container.
Figure 8C:
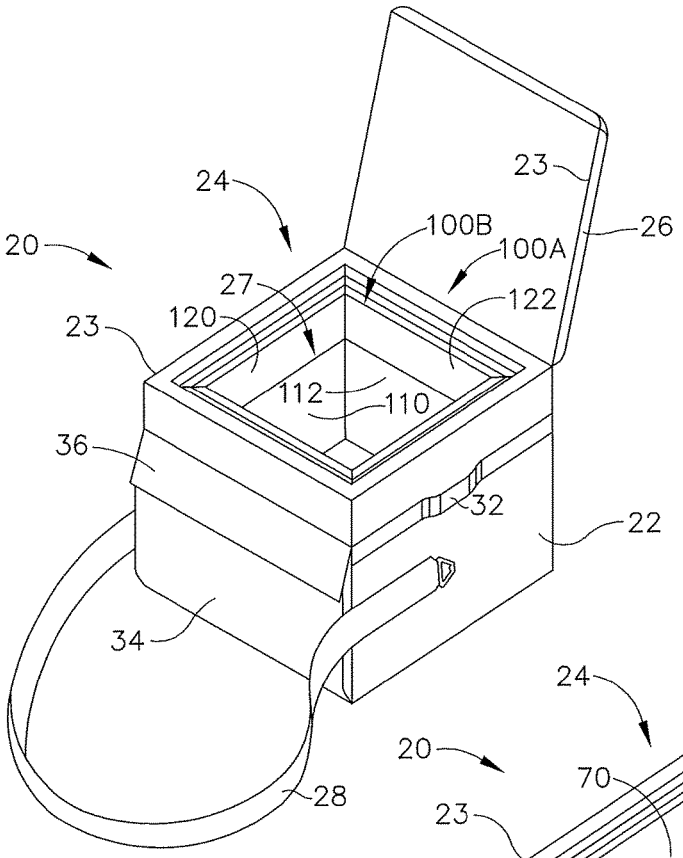
FIG. 8C depicts a perspective view of the container of FIG. 8A with the first belt of FIG. 8B positioned within the interior cavity of the container, and with a second belt, similar to the belt of FIG. 3, positioned within the interior cavity of the container.
Figure 8D:
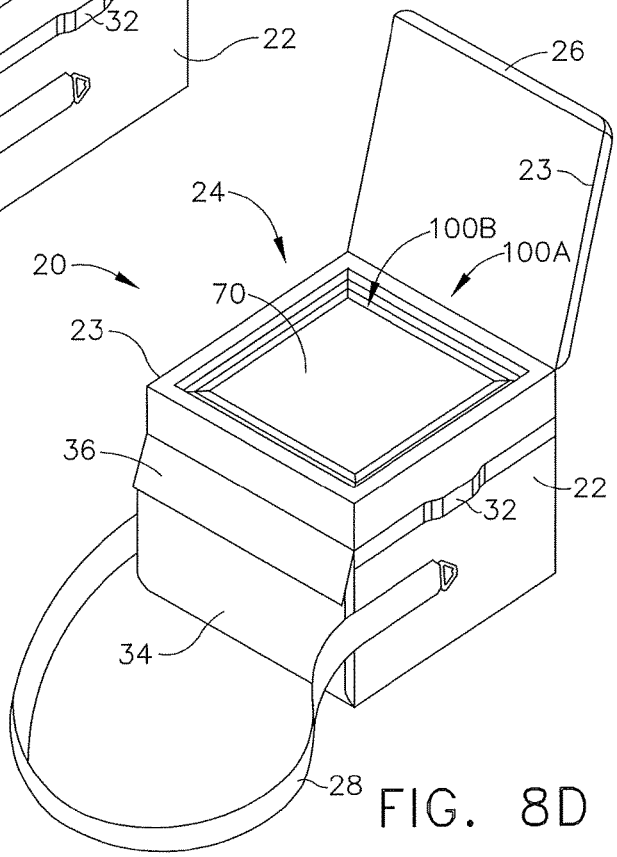
FIG. 8D depicts a perspective view of the container of FIG. 8A with the first belt of FIG. 8B and the second belt of FIG. 8C positioned within the interior cavity of the container, and with cargo positioned within the interior cavity of the container.
Figure 8E:
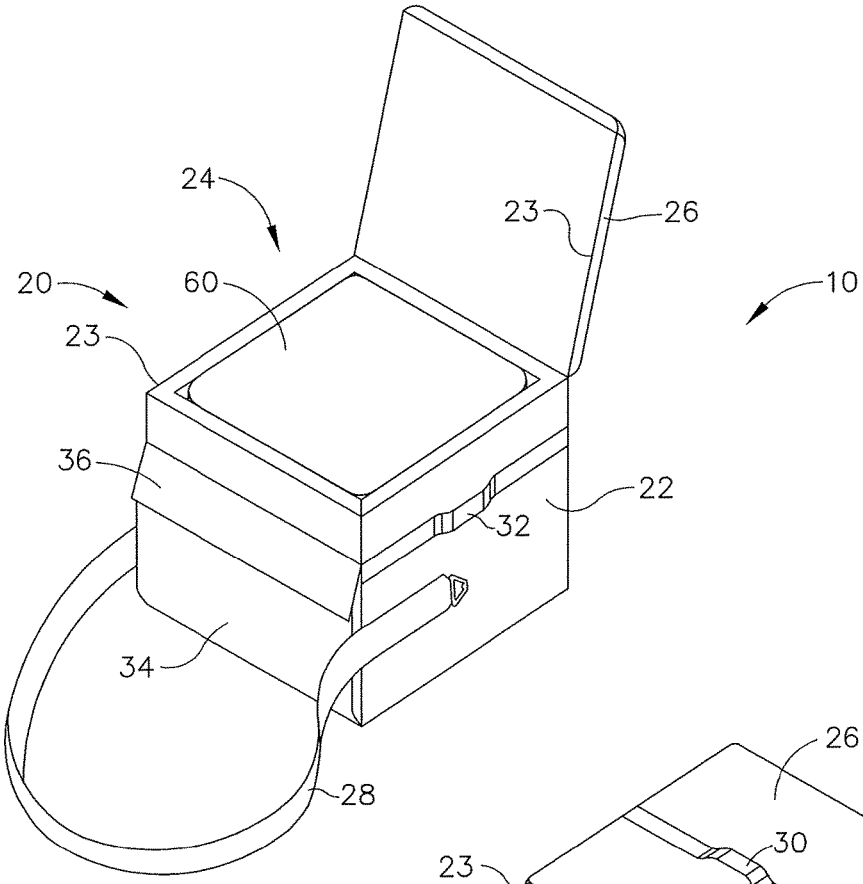
FIG. 8E depicts a perspective view of the cargo of FIG. 8A with the first belt o.
Figure 8F:
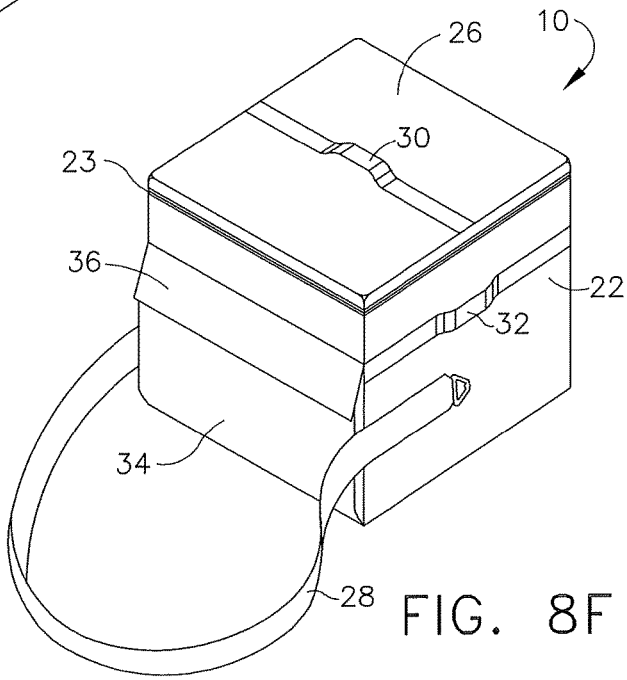
FIG. 8F depicts a perspective view of the container of FIG. 8A with a lid of the container closed over the interior cavity of the container.

FIGS. 8A-8F show the steps required to assemble container assembly (10) with belt assemblies (100A, 100B). FIG. 8A shows container (20) with lid (26) in the open position such as to provide ready access to hollow interior (24) of container (20). With lid (26) in the open position, belt assembly (100A), having first PCM packs (40) disposed therein, is folded into a square/rectangular-shaped orientation and positioned within hollow interior (24) of container (20) adjacent to an interior surface of hollow interior (24) as shown in FIG. 8B. With lid (26) still in the open position, belt assembly (100B), having second PCM packs (50) disposed therein, is folded into a square/rectangular-shaped orientation and positioned within a cavity (25) defined by an interior surface of belt assembly (100A) within hollow interior (24) of container (20) adjacent to the interior surface of belt assembly (100A) as shown in FIG. 8C. With lid (26)

remaining in the open position, cargo (70) is positioned within a cavity (27) defined by an interior surface of belt assembly (100B) within hollow interior (24) of container (20) adjacent to the interior surface of belt assembly (100B) as shown in FIG. 8D. Again, with lid (26) still in the open position, cover (70) is positioned within hollow interior (24) of container (20) atop belt assemblies (100A, 100B) and cargo (70) as shown in FIG. 8E. At this point, lid (26) is closed and lid (26) is secured in the closed position by fastening lid (26) to body (22) via zipper (23) as shown in FIG. 8F.

From the discussion above, it should be understood that when container assembly (10) is assembled, belt assembly (100B) having second PCM packs (50) disposed therein, is configured to prevent the temperature of cargo (70) from exceeding a low end of a required temperature range. It should also be understood that when container assembly (10) is assembled, belt assembly (100A) having first PCM packs (40) disposed therein, is configured to prevent the temperature of cargo (70) from exceeding a high end of a required temperature range. It should be appreciated, however, that in those versions of belt assembly (100) wherein PCM packs (40, 50) are conditioned at the same initial temperature, a first PCM pack (40) and a second PCM pack (50) may be positioned within each pouch (110, 112, 114, 116) of belt assembly (100) such that a single belt assembly (100) may be used in place of belt assemblies (100A, 100B) discussed above. PCM packs (40, 50) may be oriented within each pouch (110, 112, 114, 116) such that second PCM packs (50) are located closer than first PCM packs (40) to cargo (70) or alternatively such that first PCM packs (40) are located closer than second PCM packs (50) to cargo (70) as discussed above with reference to the orientation of belt assemblies (100A, 100B), and may be configured to prevent the temperature of cargo (70) from exceeding a low end and/or a high end of a required temperature range.

It should be appreciated that, although container assembly (10) is described as having first PCM packs (40) and second PCM packs (50) to thereby maintain the temperature of cargo (70) between an upper and lower temperature limit, container assembly (10) may have only first PCM packs (40) to thereby prevent cargo (70) from exceeding the upper temperature limit or only second PCM packs (50) to thereby prevent cargo (70) from dropping below the lower temperature limit.

Belt assemblies (100A, 100B) may be color-coded or marked to provide for simple and efficient packaging of belt assemblies (100A, 100B) within container (20). For instance, particular belt assemblies (100A, 100B) may be color-coded to correlate with first PCM packs (40) and/or second PCM packs (50). Additionally or alternatively, particular belt assemblies (100A, 100B) may be marked with "Refrigerated PCM Packs" for those belt assemblies (100B) having second PCM packs (50) and with "Frozen PCM Packs" for those belt assemblies (100A) having first PCM packs (40). The material of belt assemblies (100, 200) may be configured to provide for the printing of proper conditioning instructions thereon to provide for simple and efficient conditioning of PCM packs (40, 50). For instance, belt assemblies (100, 200) may comprise the instructions, for example, "Freeze for 12 Hours Prior to Use".

Additionally or alternatively, PCM packs (40, 50) may be color-coded or marked to provide for simple and efficient packaging of PCM packs (40, 50) within each pouch (110, 112, 114, 116) of belt assemblies (100A, 100B). For instance, PCM packs (40, 50) may be color-coded and/or may be marked with "Refrigerated PCM Packs" for second PCM packs (50) or with "Frozen PCM Packs" for first PCM packs (40). The flexible film material of PCM packs (40, 50) may be configured to provide for the printing of proper conditioning instructions thereon to provide for simple and efficient conditioning of PCM packs (40, 50). For instance, first PCM packs (50) may comprise the instructions "Freeze for 12 Hours Prior to Use".

It should be appreciated from the discussion above that belt assemblies (100, 200) provide for reduced handling of PCM packs (40, 50) when assembling container assembly (10) and/or conditioning PCM packs (40, 50) prior to use. Furthermore, it should be understood that belt assemblies (100, 200) may be folded to provide for efficient storage in a refrigerator or freezer during non-use.

Although PCM packs (40, 50) are discussed above as cooling cargo (70), it should be understood that PCM packs (40, 50) may be used to provide heat to cargo (70).

EXAMPLES

I. Example 1

Figure 9:
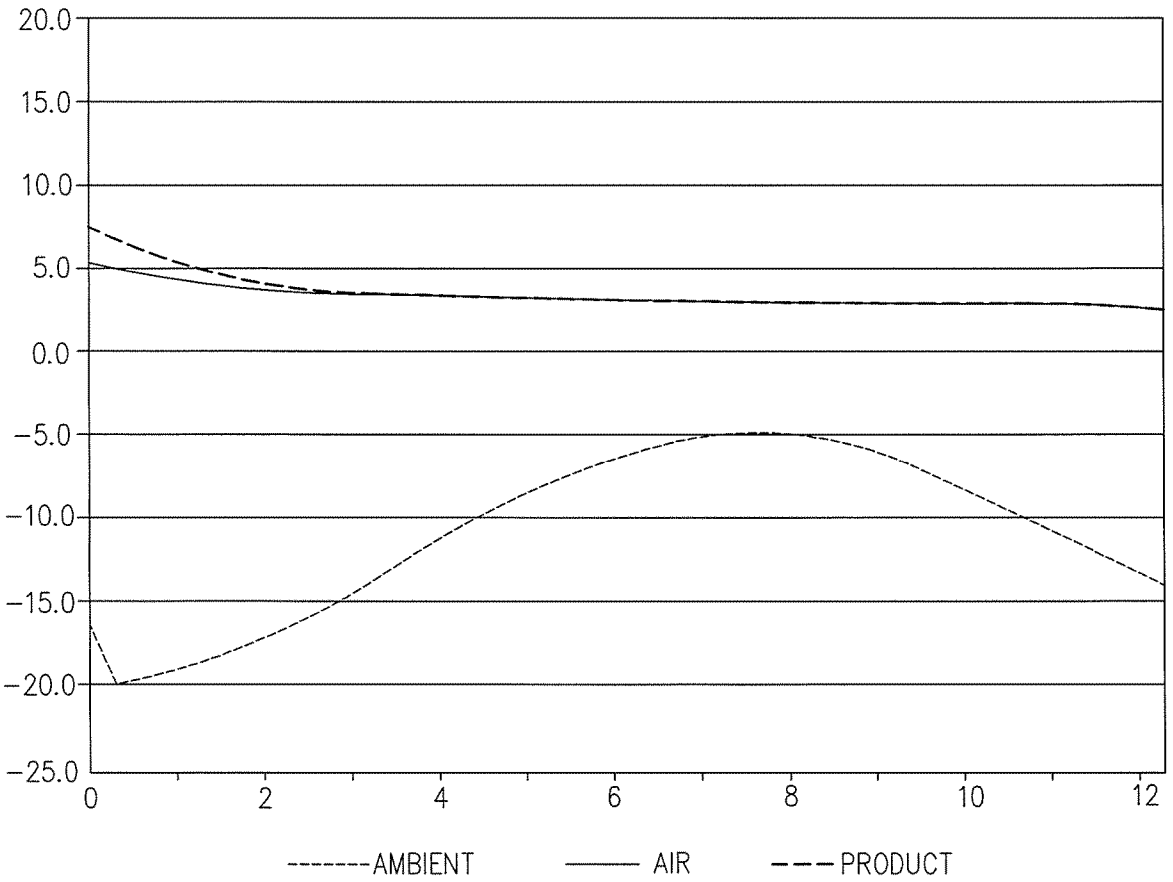
FIG. 9 depicts a time vs. temperature graph that follows how an exemplary container assembly having a pair of belts with PCM packs kept cargo and air within the container assembly between a given criteria of 2° C. and 8° C. when exposed to a simulated 12-hour winter transit ambient.

FIG. 9 shows an example of container assembly (10) exposed to a particular set of environment conditions while having belt assembly (100A), containing first PCM packs (40), conditioned at −20° C. (−4° F.) and belt assembly (100B), containing second PCM packs (50), conditioned at 5° C. (41° F.) and the effect such environmental conditions have on the temperature of air within container (20) and of cargo (70) within container (20). First PCM packs (40) of the present example comprised paraffin material. Second PCM packs (50) of the present example comprised paraffin material. In particular, container assembly (10) was exposed to a change in ambient temperature over the course of 12 hours from an initial temperature of approximately −20° C. (−4° F.) to a temperature of approximately −5° C. (23° F.) at 7 hours and a final temperature of approximately −14° C. (6.8° F.). As shown in FIG. 9, although the exterior of the container assembly (10) is exposed to a significant change in temperature over a substantial period of time, the temperature of the air within container (20) and of the cargo (70) was insulated from such a temperature change by PCM packs (40, 50). In particular, the temperature of the air within container (20) had an initial temperature of approximately 5° C. (41° F.) and a final temperature of approximately 2° C. (35.6° F.) with no significant fluctuations there between; while the temperature of cargo (70) had an initial temperature of approximately 7° C. (44.6° F.) and a final temperature of 2° C. (35.6° F.) with no significant fluctuations there between. Thus it should be appreciated that PCM packs (40, 50) are operable to prevent the temperature of cargo (70) from exceeding a low end of a required temperature range when container assembly (10) is exposed to low temperatures and are further operable to reduce the effect external temperature fluctuations have on the temperature of cargo (70) within container (20).

Table 1 below contains data correlating with the chart of FIG. 9:

TABLE 1

| Hours | Product (° C.) | Air (° C.) | Ambient (° C.) |
|---|---|---|---|
| 0 | 7.3 | 5.3 | −17.5 |
| 0.2 | 6.9 | 5.1 | −19.8 |
| 0.3 | 6.4 | 4.9 | −19.6 |
| 0.5 | 6.0 | 4.7 | −19.5 |

TABLE 1-continued

| Hours | Product (° C.) | Air (° C.) | Ambient (° C.) |
|---|---|---|---|
| 0.7 | 5.6 | 4.5 | −19.4 |
| 0.8 | 5.3 | 4.4 | −19.1 |
| 1 | 5.1 | 4.3 | −18.8 |
| 1.2 | 4.9 | 4.1 | −18.4 |
| 1.3 | 4.7 | 4.0 | −18.2 |
| 1.5 | 4.5 | 4.0 | −17.7 |
| 1.7 | 4.4 | 3.9 | −17.4 |
| 1.8 | 4.2 | 3.8 | −17.2 |
| 2 | 4.1 | 3.7 | −16.7 |
| 2.2 | 4.0 | 3.6 | −16.3 |
| 2.3 | 3.9 | 3.6 | −15.8 |
| 2.5 | 3.8 | 3.5 | −15.4 |
| 2.7 | 3.6 | 3.4 | −14.9 |
| 2.8 | 3.5 | 3.4 | −14.6 |
| 3 | 3.4 | 3.3 | −14.0 |
| 3.2 | 3.3 | 3.3 | −13.6 |
| 3.3 | 3.3 | 3.2 | −12.9 |
| 3.5 | 3.2 | 3.2 | −12.6 |
| 3.7 | 3.2 | 3.1 | −12.0 |
| 3.8 | 3.1 | 3.1 | −11.4 |
| 4 | 3.1 | 3.1 | −11.1 |
| 4.2 | 3.1 | 3.1 | −10.4 |
| 4.3 | 3.0 | 3.1 | −10.0 |
| 4.5 | 3.0 | 3.0 | −9.6 |
| 4.7 | 3.0 | 3.0 | −9.2 |
| 4.8 | 3.0 | 3.0 | −8.9 |
| 5 | 3.0 | 3.0 | −8.4 |
| 5.2 | 3.0 | 3.0 | −8.1 |
| 5.3 | 3.0 | 3.0 | −7.6 |
| 5.5 | 2.9 | 3.0 | −7.2 |
| 5.7 | 2.9 | 2.9 | −6.9 |
| 5.8 | 2.9 | 2.9 | −6.6 |
| 6 | 2.9 | 2.9 | −6.1 |
| 6.2 | 2.9 | 2.9 | −6.0 |
| 6.3 | 2.9 | 2.9 | −5.8 |
| 6.5 | 2.9 | 2.9 | −5.6 |
| 6.7 | 2.8 | 2.9 | −5.6 |
| 6.8 | 2.8 | 2.8 | −5.4 |
| 7 | 2.8 | 2.8 | −5.1 |
| 7.2 | 2.8 | 2.8 | −5.3 |
| 7.3 | 2.8 | 2.8 | −5.4 |
| 7.5 | 2.8 | 2.8 | −5.3 |
| 7.7 | 2.8 | 2.8 | −5.5 |
| 7.8 | 2.8 | 2.8 | −5.4 |
| 8 | 2.8 | 2.8 | −5.7 |
| 8.2 | 2.7 | 2.7 | −5.9 |
| 8.3 | 2.7 | 2.7 | −5.8 |
| 8.5 | 2.7 | 2.6 | −6.1 |
| 8.7 | 2.7 | 2.6 | −6.3 |
| 8.8 | 2.6 | 2.6 | −6.3 |
| 9 | 2.6 | 2.6 | −6.6 |
| 9.2 | 2.6 | 2.6 | −7.1 |
| 9.3 | 2.6 | 2.5 | −7.5 |
| 9.5 | 2.6 | 2.5 | −7.8 |
| 9.7 | 2.5 | 2.5 | −8.1 |
| 9.8 | 2.5 | 2.5 | −8.6 |
| 10 | 2.5 | 2.4 | −9.1 |
| 10.2 | 2.5 | 2.4 | −9.6 |
| 10.3 | 2.4 | 2.4 | −10.1 |
| 10.5 | 2.4 | 2.3 | −10.4 |
| 10.7 | 2.4 | 2.3 | −10.8 |
| 10.8 | 2.3 | 2.3 | −11.2 |
| 11 | 2.3 | 2.2 | −11.7 |
| 11.2 | 2.3 | 2.1 | −12.2 |
| 11.3 | 2.2 | 2.1 | −12.6 |
| 11.5 | 2.2 | 2.1 | −13.0 |
| 11.7 | 2.1 | 2.0 | −13.4 |
| 11.8 | 2.1 | 2.0 | −13.8 |
| 12 | 2.0 | 1.9 | −14.3 |

II. Example 2

Figure 10:
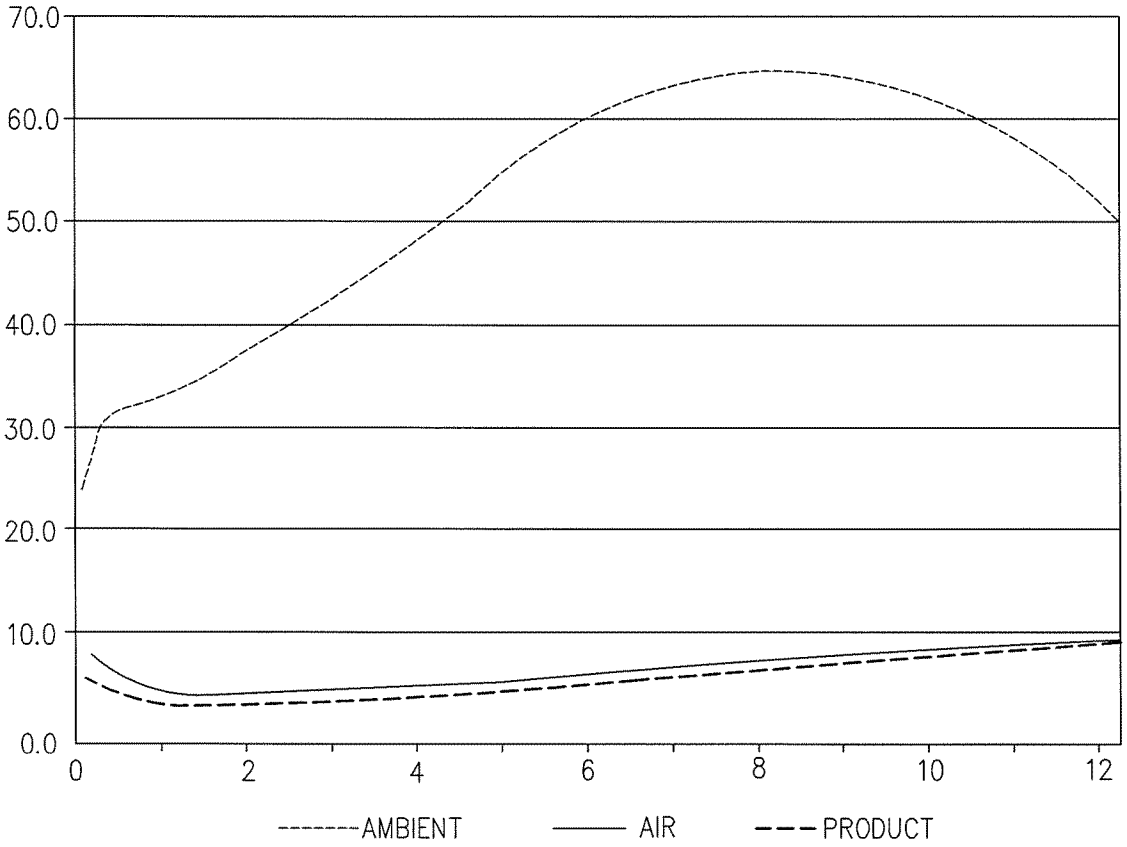
FIG. 10 depicts a time vs. temperature graph that follows how an exemplary container assembly having a pair of belts with PCM packs kept cargo and air within the container assembly between a given criteria of 2° C. and 8° C. when exposed to a simulated 12-hour summer transit ambient.

FIG. 10 shows an example of container assembly (10) exposed to a particular set of environment conditions while having belt assembly (100A), containing first PCM packs (40), conditioned at −20° C. (−4° F.) and belt assembly (100B), containing second PCM packs (50), conditioned at 5° C. (41° F.) and the effect such environmental conditions have on the temperature of air within container (20) and of cargo (70) within container (20). First PCM packs (40) of the present example comprised paraffin material. Second PCM packs (50) of the present example comprised paraffin material. In particular, container assembly (10) was exposed to a change in ambient temperature over the course of 12 hours from an initial temperature of approximately 25° C. (77° F.) to a temperature of approximately 64° C. (147.2° F.) at 8 hours and a final temperature of approximately 50° C. (122° F.). As shown in FIG. 10, although the exterior of the container assembly (10) is exposed to a significant change in temperature over a substantial period of time, the temperature of the air within container (20) and of the cargo (70) was insulated from such a temperature change by PCM packs (40, 50). In particular, the temperature of the air within container (20) had an initial temperature of approximately 8° C. (46.4° F.) and a final temperature of 9° C. (48.2° F.) with no significant fluctuations there between; while the temperature of cargo (70) had an initial temperature of approximately 6° C. (42.8° F.) and a final temperature of 8° C. (46.4° F.) with no significant fluctuations there between. Thus it should be appreciated that PCM packs (40, 50) are operable to prevent the temperature of cargo (70) from exceeding a high end of a required temperature range when container assembly (10) is exposed to high temperatures and are further operable to reduce the effect external temperature fluctuations have on the temperature of cargo (70) within container (20).

Table 2 below contains data correlating with the chart of FIG. 10:

TABLE 2

| Hours | Product (° C.) | Air (° C.) | Ambient (° C.) |
|---|---|---|---|
| 0 | 6.1 | 7.7 | 24.5 |
| 0.2 | 5.5 | 6.8 | 29.9 |
| 0.3 | 4.7 | 5.9 | 31.6 |
| 0.5 | 4.4 | 4.8 | 32.3 |
| 0.7 | 4.1 | 4.5 | 32.8 |
| 0.8 | 3.8 | 4.3 | 33.2 |
| 1 | 3.7 | 4.0 | 33.6 |
| 1.2 | 3.7 | 3.8 | 34.2 |
| 1.3 | 3.6 | 3.7 | 34.8 |
| 1.5 | 3.6 | 3.6 | 35.6 |
| 1.7 | 3.7 | 3.6 | 36.4 |
| 1.8 | 3.7 | 3.7 | 37.2 |
| 2 | 3.8 | 3.7 | 38.1 |
| 2.2 | 3.8 | 3.7 | 38.8 |
| 2.3 | 3.9 | 3.8 | 39.6 |
| 2.5 | 3.9 | 3.8 | 40.4 |
| 2.7 | 4.0 | 3.9 | 41.3 |
| 2.8 | 4.0 | 4.0 | 42.1 |
| 3 | 4.0 | 4.0 | 42.9 |
| 3.2 | 4.1 | 4.1 | 43.8 |
| 3.3 | 4.1 | 4.1 | 44.7 |
| 3.5 | 4.1 | 4.2 | 45.7 |
| 3.7 | 4.1 | 4.2 | 46.7 |
| 3.8 | 4.2 | 4.3 | 47.6 |
| 4 | 4.3 | 4.3 | 48.6 |
| 4.2 | 4.3 | 4.4 | 49.6 |
| 4.3 | 4.3 | 4.5 | 50.5 |
| 4.5 | 4.4 | 4.5 | 51.4 |
| 4.7 | 4.4 | 4.6 | 52.4 |
| 4.8 | 4.5 | 4.7 | 53.4 |
| 5 | 4.5 | 4.7 | 54.3 |
| 5.2 | 4.6 | 4.8 | 55.2 |
| 5.3 | 4.6 | 4.9 | 56.2 |
| 5.5 | 4.7 | 5.0 | 56.9 |
| 5.7 | 4.8 | 5.1 | 57.8 |
| 5.8 | 4.8 | 5.1 | 58.6 |
| 6 | 4.9 | 5.2 | 59.4 |

TABLE 2-continued

| Hours | Product (° C.) | Air (° C.) | Ambient (° C.) |
|---|---|---|---|
| 6.2 | 5.0 | 5.3 | 60.1 |
| 6.3 | 5.0 | 5.4 | 60.6 |
| 6.5 | 5.1 | 5.5 | 61.1 |
| 6.7 | 5.2 | 5.6 | 61.6 |
| 6.8 | 5.3 | 5.7 | 62.1 |
| 7 | 5.4 | 5.7 | 62.6 |
| 7.2 | 5.4 | 5.8 | 62.9 |
| 7.3 | 5.5 | 6.0 | 63.2 |
| 7.5 | 5.6 | 6.0 | 63.4 |
| 7.7 | 5.7 | 6.1 | 63.6 |
| 7.8 | 5.8 | 6.2 | 63.8 |
| 8 | 5.8 | 6.3 | 63.9 |
| 8.2 | 5.9 | 6.4 | 63.9 |
| 8.3 | 6.0 | 6.5 | 63.8 |
| 8.5 | 6.1 | 6.6 | 63.7 |
| 8.7 | 6.2 | 6.7 | 63.6 |
| 8.8 | 6.3 | 6.8 | 63.4 |
| 9 | 6.4 | 6.9 | 63.2 |
| 9.2 | 6.4 | 7.0 | 62.8 |
| 9.3 | 6.5 | 7.1 | 62.4 |
| 9.5 | 6.6 | 7.2 | 61.9 |
| 9.7 | 6.6 | 7.3 | 61.5 |
| 9.8 | 6.8 | 7.4 | 61.0 |
| 10 | 6.9 | 7.5 | 60.6 |
| 10.2 | 6.9 | 7.6 | 59.9 |
| 10.3 | 7.0 | 7.7 | 59.2 |
| 10.5 | 7.1 | 7.8 | 58.5 |
| 10.7 | 7.2 | 7.9 | 57.8 |
| 10.8 | 7.3 | 8.0 | 56.9 |
| 11 | 7.4 | 8.1 | 56.2 |
| 11.2 | 7.5 | 8.2 | 55.2 |
| 11.3 | 7.6 | 8.2 | 54.3 |
| 11.5 | 7.6 | 8.3 | 53.3 |
| 11.7 | 7.8 | 8.5 | 52.3 |
| 11.8 | 7.8 | 8.5 | 51.4 |
| 12 | 7.9 | 8.6 | 50.4 |

III. Example 3

Figure 11:
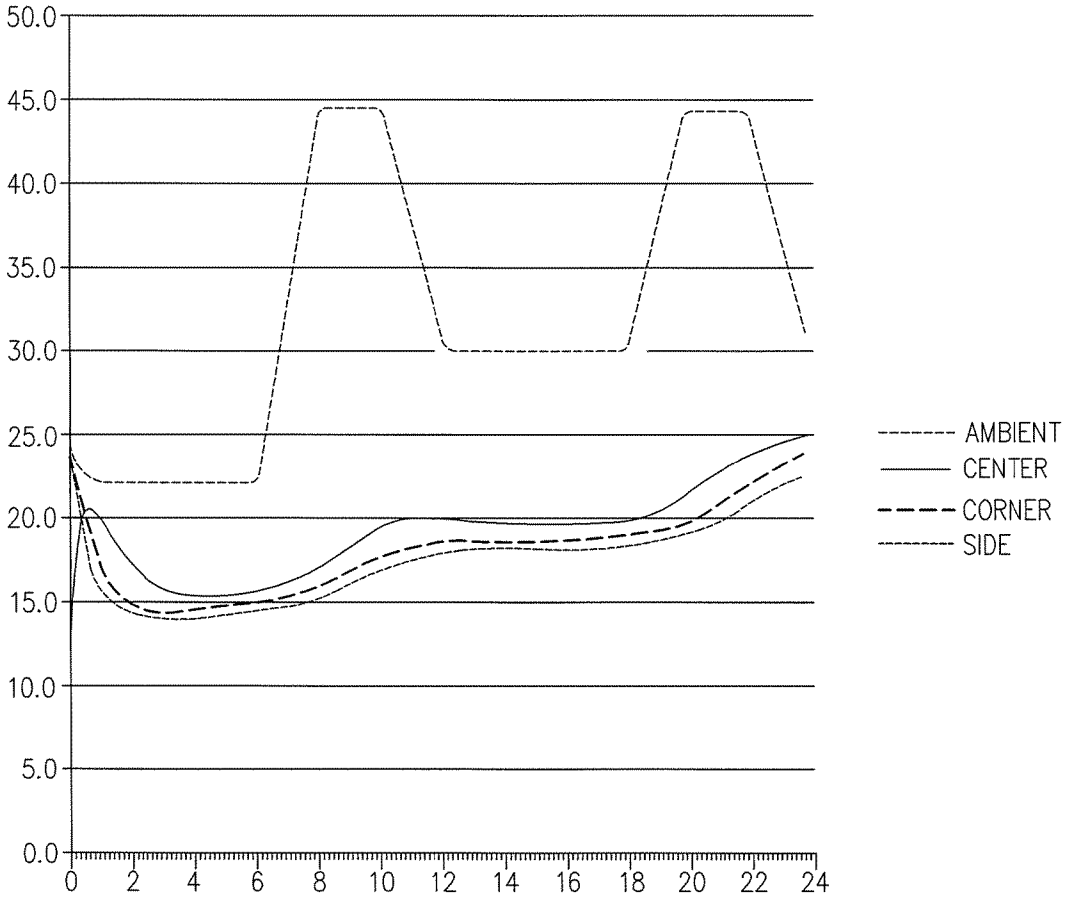
FIG. 11 depicts a time vs. temperature graph that follows how an exemplary container assembly having a pair of belts with PCM packs kept cargo and air within the container assembly between a given criteria of 2° C. and 25° C. when exposed to a simulated 24-hour summer transit ambient.
Figure 12:
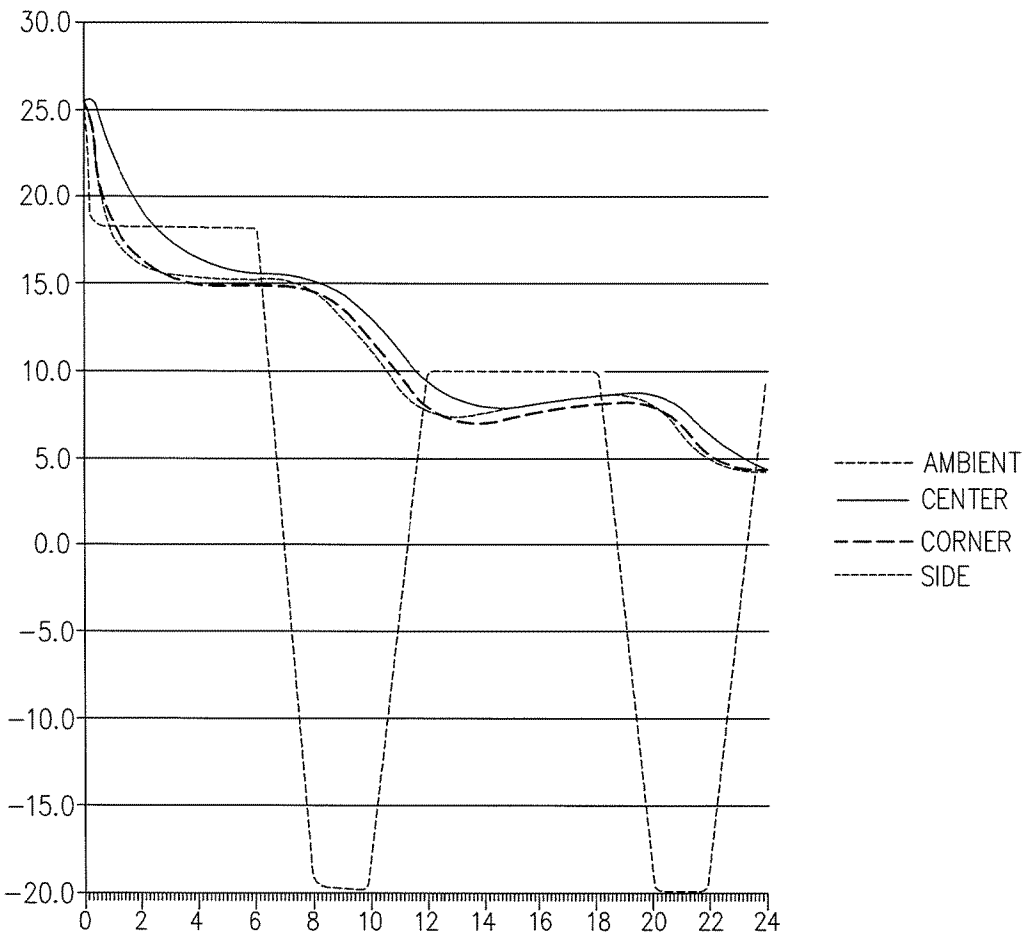
FIG. 12 depicts a time vs. temperature graph that follows how an exemplary container assembly having a pair of belts with PCM packs kept cargo and air within the container assembly between a given criteria of 2° C. and 25° C. when exposed to a simulated 24-hour winter transit ambient.

FIG. 11 shows an example of container assembly (10) exposed to a particular set of environment conditions while having belt assembly (100A), containing first PCM packs (40), conditioned at 5° C. (41° F.) and belt assembly (100B), containing second PCM packs (50), conditioned at 5° C. (41° F.) and the effect such environmental conditions have on the temperature within container (20) at a center position, a side position, and a corner position of cargo (70) within container (20). First PCM packs (40) of the present example comprised paraffin material. Second PCM packs (50) of the present example comprised paraffin material. In particular, container assembly (10) was exposed to a change in ambient temperature over the course of 24 hours from an initial temperature of approximately 22° C. (71.6° F.) from hours 0 to 6, to a temperature of approximately 44° C. (111.2° F.) for hours 9 and 10, to a temperature of approximately 30° C. (86° F.) from hours 13 to 18, to a temperature of approximately 44° C. (111.2° F.) for hours 21 and 22, and to a final temperature of approximately 30° C. (86° F.) at hour 24. As shown in FIG. 12, although the exterior of the container assembly (10) is exposed to a significant change in temperature over a substantial period of time, the temperature within container (20) was insulated from such significant temperature changes by PCM packs (40, 50). In particular, the temperature within container (20) at the center position had an initial temperature of approximately 13° C. (55.4° F.), an intermediate temperature of approximately 20° C. (68° F.), and a final temperature of approximately 25° C. (77° F.) with no significant fluctuations there between. The temperature within container (20) at the side position had an initial temperature of approximately 24° C. (75.2° F.), an intermediate temperature of approximately 18° C. (64.4° F.), and a final temperature of approximately 22° C. (71.6° F.) with no significant fluctuations there between. The temperature within container (20) at the corner position had an initial temperature of approximately 25° C. (77° F.), an intermediate temperature of approximately 19° C. (66.2° F.), and a final temperature of approximately 24° C. (75.2° F.) with no significant fluctuations there between. Thus it should again be appreciated that PCM packs (40, 50) are operable to prevent the temperature of cargo (70) from exceeding a high end of a required temperature range when container assembly (10) is exposed to high temperatures and are further operable to reduce the effect external temperature fluctuations have on the temperature of cargo (70) within container (20).

Table 3 below contains data correlating with the chart of FIG. 11:

TABLE 3

| Hours | Ambient (° C.) | Center (° C.) | Side (° C.) | Corner (° C.) |
|---|---|---|---|---|
| 0.00 | 24.3 | 13.4 | 24.4 | 24.5 |
| 0.17 | 21.2 | 18.4 | 24.7 | 23.8 |
| 0.33 | 21.4 | 20.1 | 22.4 | 20.8 |
| 0.50 | 21.7 | 20.6 | 20.4 | 18.7 |
| 0.67 | 21.8 | 20.4 | 18.9 | 17.3 |
| 0.83 | 21.9 | 20.1 | 17.9 | 16.4 |
| 1.00 | 21.9 | 19.6 | 17.1 | 15.8 |
| 1.17 | 21.9 | 19.1 | 16.4 | 15.4 |
| 1.33 | 21.9 | 18.6 | 15.9 | 15.1 |
| 1.50 | 21.9 | 18.1 | 15.6 | 14.8 |
| 1.67 | 21.9 | 17.7 | 15.2 | 14.7 |
| 1.83 | 21.9 | 17.3 | 14.9 | 14.5 |
| 2.00 | 21.9 | 16.9 | 14.7 | 14.4 |
| 2.17 | 21.9 | 16.7 | 14.6 | 14.3 |
| 2.33 | 21.9 | 16.4 | 14.4 | 14.3 |
| 2.50 | 21.9 | 16.2 | 14.3 | 14.3 |
| 2.67 | 21.9 | 16.0 | 14.2 | 14.3 |
| 2.83 | 21.9 | 15.8 | 14.1 | 14.2 |
| 3.00 | 21.9 | 15.7 | 14.1 | 14.2 |
| 3.17 | 21.8 | 15.6 | 14.0 | 14.3 |
| 3.33 | 21.9 | 15.6 | 14.0 | 14.3 |
| 3.50 | 21.9 | 15.4 | 14.0 | 14.3 |
| 3.67 | 21.9 | 15.4 | 14.0 | 14.3 |
| 3.83 | 21.9 | 15.4 | 14.0 | 14.3 |
| 4.00 | 21.9 | 15.3 | 14.0 | 14.4 |
| 4.17 | 21.9 | 15.3 | 14.0 | 14.4 |
| 4.33 | 21.8 | 15.3 | 14.1 | 14.4 |
| 4.50 | 21.8 | 15.3 | 14.1 | 14.5 |
| 4.67 | 21.9 | 15.3 | 14.1 | 14.5 |
| 4.83 | 21.9 | 15.4 | 14.1 | 14.6 |
| 5.00 | 21.9 | 15.4 | 14.2 | 14.6 |
| 5.17 | 21.9 | 15.4 | 14.2 | 14.7 |
| 5.33 | 21.9 | 15.4 | 14.2 | 14.7 |
| 5.50 | 21.9 | 15.4 | 14.3 | 14.7 |
| 5.67 | 21.9 | 15.5 | 14.3 | 14.8 |
| 5.83 | 21.9 | 15.5 | 14.3 | 14.8 |
| 6.00 | 21.9 | 15.6 | 14.4 | 14.9 |
| 6.17 | 22.9 | 15.6 | 14.4 | 14.9 |
| 6.33 | 24.6 | 15.6 | 14.5 | 14.9 |
| 6.50 | 26.4 | 15.6 | 14.5 | 15.0 |
| 6.67 | 28.2 | 15.7 | 14.6 | 15.1 |
| 6.83 | 29.9 | 15.7 | 14.6 | 15.1 |
| 7.00 | 31.8 | 15.8 | 14.7 | 15.2 |
| 7.17 | 33.7 | 15.9 | 14.7 | 15.2 |
| 7.33 | 35.5 | 16.1 | 14.8 | 15.3 |
| 7.50 | 37.4 | 16.2 | 14.8 | 15.4 |
| 7.67 | 39.3 | 16.3 | 14.9 | 15.5 |
| 7.83 | 41.2 | 16.6 | 15.0 | 15.6 |
| 8.00 | 43.1 | 16.7 | 15.1 | 15.7 |
| 8.17 | 43.9 | 16.9 | 15.2 | 15.8 |
| 8.33 | 44.2 | 17.2 | 15.3 | 15.9 |
| 8.50 | 44.3 | 17.4 | 15.4 | 16.1 |
| 8.67 | 44.3 | 17.7 | 15.6 | 16.3 |
| 8.83 | 44.3 | 17.9 | 15.7 | 16.4 |

TABLE 3-continued

| Hours | Ambient (° C.) | Center (° C.) | Side (° C.) | Corner (° C.) |
|---|---|---|---|---|
| 9.00 | 44.3 | 18.1 | 15.8 | 16.6 |
| 9.17 | 44.3 | 18.3 | 15.9 | 16.7 |
| 9.33 | 44.3 | 18.5 | 16.1 | 16.8 |
| 9.50 | 44.3 | 18.7 | 16.3 | 17.0 |
| 9.67 | 44.4 | 18.9 | 16.4 | 17.1 |
| 9.83 | 44.4 | 19.0 | 16.6 | 17.3 |
| 10.00 | 44.4 | 19.2 | 16.7 | 17.4 |
| 10.17 | 43.8 | 19.3 | 16.8 | 17.5 |
| 10.33 | 42.8 | 19.5 | 16.9 | 17.6 |
| 10.50 | 41.7 | 19.6 | 17.1 | 17.8 |
| 10.67 | 40.4 | 19.7 | 17.2 | 17.9 |
| 10.83 | 39.2 | 19.8 | 17.3 | 17.9 |
| 11.00 | 38.0 | 19.8 | 17.4 | 18.1 |
| 11.17 | 36.7 | 19.9 | 17.5 | 18.1 |
| 11.33 | 35.5 | 19.9 | 17.6 | 18.2 |
| 11.50 | 34.3 | 19.9 | 17.7 | 18.3 |
| 11.67 | 33.1 | 19.9 | 17.7 | 18.3 |
| 11.83 | 31.8 | 19.9 | 17.8 | 18.3 |
| 12.00 | 30.6 | 19.9 | 17.9 | 18.4 |
| 12.17 | 30.1 | 19.9 | 17.9 | 18.4 |
| 12.33 | 29.9 | 19.8 | 17.9 | 18.4 |
| 12.50 | 29.9 | 19.8 | 18.0 | 18.4 |
| 12.67 | 29.9 | 19.8 | 18.0 | 18.4 |
| 12.83 | 29.9 | 19.7 | 18.0 | 18.4 |
| 13.00 | 29.9 | 19.7 | 18.0 | 18.4 |
| 13.17 | 29.9 | 19.7 | 18.1 | 18.4 |
| 13.33 | 29.8 | 19.6 | 18.1 | 18.4 |
| 13.50 | 29.9 | 19.6 | 18.1 | 18.4 |
| 13.67 | 29.9 | 19.6 | 18.1 | 18.4 |
| 13.83 | 29.9 | 19.6 | 18.1 | 18.4 |
| 14.00 | 29.8 | 19.6 | 18.1 | 18.4 |
| 14.17 | 29.8 | 19.6 | 18.1 | 18.4 |
| 14.33 | 29.8 | 19.6 | 18.1 | 18.5 |
| 14.50 | 29.8 | 19.6 | 18.1 | 18.5 |
| 14.67 | 29.8 | 19.6 | 18.1 | 18.5 |
| 14.83 | 29.8 | 19.6 | 18.1 | 18.5 |
| 15.00 | 29.8 | 19.6 | 18.1 | 18.5 |
| 15.17 | 29.8 | 19.6 | 18.1 | 18.5 |
| 15.33 | 29.8 | 19.6 | 18.1 | 18.6 |
| 15.50 | 29.8 | 19.6 | 18.1 | 18.6 |
| 15.67 | 29.8 | 19.6 | 18.1 | 18.6 |
| 15.83 | 29.8 | 19.6 | 18.1 | 18.6 |
| 16.00 | 29.8 | 19.6 | 18.1 | 18.6 |
| 16.17 | 29.8 | 19.6 | 18.2 | 18.6 |
| 16.33 | 29.8 | 19.6 | 18.2 | 18.6 |
| 16.50 | 29.8 | 19.7 | 18.2 | 18.7 |
| 16.67 | 29.8 | 19.7 | 18.2 | 18.7 |
| 16.83 | 29.8 | 19.7 | 18.2 | 18.7 |
| 17.00 | 29.8 | 19.7 | 18.2 | 18.7 |
| 17.17 | 29.8 | 19.7 | 18.2 | 18.7 |
| 17.33 | 29.8 | 19.7 | 18.3 | 18.7 |
| 17.50 | 29.8 | 19.7 | 18.3 | 18.8 |
| 17.67 | 29.8 | 19.8 | 18.3 | 18.8 |
| 17.83 | 29.8 | 19.8 | 18.3 | 18.8 |
| 18.00 | 29.8 | 19.8 | 18.3 | 18.8 |
| 18.17 | 30.4 | 19.8 | 18.3 | 18.9 |
| 18.33 | 31.4 | 19.9 | 18.4 | 18.9 |
| 18.50 | 32.6 | 19.9 | 18.4 | 18.9 |
| 18.67 | 33.8 | 19.9 | 18.4 | 18.9 |
| 18.83 | 35.0 | 19.9 | 18.4 | 18.9 |
| 19.00 | 36.2 | 20.0 | 18.4 | 19.0 |
| 19.17 | 37.4 | 20.1 | 18.5 | 19.1 |
| 19.33 | 38.6 | 20.2 | 18.6 | 19.1 |
| 19.50 | 39.8 | 20.3 | 18.6 | 19.2 |
| 19.67 | 41.1 | 20.4 | 18.7 | 19.3 |
| 19.83 | 42.3 | 20.6 | 18.7 | 19.3 |
| 20.00 | 43.5 | 20.8 | 18.8 | 19.4 |
| 20.17 | 44.1 | 21.0 | 18.9 | 19.6 |
| 20.33 | 44.3 | 21.2 | 18.9 | 19.7 |
| 20.50 | 44.3 | 21.4 | 19.1 | 19.9 |
| 20.67 | 44.4 | 21.6 | 19.2 | 20.1 |
| 20.83 | 44.4 | 21.8 | 19.3 | 20.2 |
| 21.00 | 44.4 | 22.1 | 19.4 | 20.4 |
| 21.17 | 44.4 | 22.2 | 19.6 | 20.6 |
| 21.33 | 44.4 | 22.4 | 19.7 | 20.8 |
| 21.50 | 44.4 | 22.7 | 19.9 | 21.0 |
| 21.67 | 44.4 | 22.9 | 20.0 | 21.2 |
| 21.83 | 44.5 | 23.1 | 20.2 | 21.4 |

TABLE 3-continued

| Hours | Ambient (° C.) | Center (° C.) | Side (° C.) | Corner (° C.) |
|---|---|---|---|---|
| 22.00 | 44.6 | 23.3 | 20.4 | 21.6 |
| 22.17 | 43.9 | 23.4 | 20.6 | 21.8 |
| 22.33 | 42.8 | 23.7 | 20.7 | 22.1 |
| 22.50 | 41.6 | 23.8 | 20.9 | 22.3 |
| 22.67 | 40.4 | 24.0 | 21.1 | 22.4 |
| 22.83 | 39.2 | 24.1 | 21.2 | 22.7 |
| 23.00 | 38.0 | 24.3 | 21.4 | 22.8 |
| 23.17 | 36.7 | 24.4 | 21.6 | 23.0 |
| 23.33 | 35.6 | 24.4 | 21.7 | 23.2 |
| 23.50 | 34.3 | 24.5 | 21.9 | 23.3 |
| 23.67 | 33.1 | 24.6 | 22.0 | 23.4 |
| 23.83 | 31.9 | 24.6 | 22.2 | 23.6 |
| 24.00 | 30.6 | 24.7 | 22.2 | 23.7 |

IV. Example 4

FIG. 12 shows an example of container assembly (10) exposed to a particular set of environment conditions while having belt assembly (100A), containing first PCM packs (40), conditioned at 5° C. (41° F.) and belt assembly (100B), containing second PCM packs (50), conditioned at 5° C. (41° F.) and the effect such environmental conditions have on the temperature within container (20) at a center position, a side position, and a corner position of cargo (70) within container (20). First PCM packs (40) of the present example comprised paraffin material. Second PCM packs (50) of the present example comprised paraffin material. In particular, container assembly (10) was exposed to a change in ambient temperature over the course of 24 hours from an initial temperature of approximately 18° C. (64.4° F.) from hours 0 to 6, to a temperature of approximately −20° C. (−4° F.) for hours 9 and 10, to a temperature of approximately 10° C. (50° F.) from hours 13 to 18, to a temperature of approximately −20° C. (−4° F.) for hours 21 and 22, and to a final temperature of approximately 9° C. (48.2° F.) at hour 24. As shown in FIG. 13, although the exterior of the container assembly (10) is exposed to a significant change in temperature over a substantial period of time, the temperature within container (20) was insulated from such significant temperature changes by PCM packs (40, 50). In particular, the temperature within container (20) at the center position had an initial temperature of approximately 26° C. (78.8° F.), a first intermediate temperature of approximately 16° C. (60.8° F.) at hour 6, a second intermediate temperature of approximately 8° C. (46.4° F.) at hour 18, and a final temperature of approximately 4° C. (39.2° F.) with no significant fluctuations there between. The temperature within container (20) at the side position had an initial temperature of approximately 25° C. (77° F.), a first intermediate temperature of approximately 15° C. (59° F.) at hour 6, a second intermediate temperature of approximately 8° C. (46.4° F.) at hour 18, and a final temperature of approximately 4° C. (39.2° F.) with no significant fluctuations there between. The temperature within container (20) at the corner position had an initial temperature of approximately 26° C. (78.8° F.), a first intermediate temperature of approximately 15° C. (59° F.) at hour 6, a second intermediate temperature of approximately 8° C. (46.4° F.) at hour 18, and a final temperature of approximately 4° C. (39.2° F.) with no significant fluctuations there between. Thus it should again be appreciated that PCM packs (40, 50) are operable to prevent the temperature of cargo (70) from exceeding a high end of a required temperature range when container assembly (10) is exposed to high temperatures and are further operable to reduce the effect external temperature fluctuations have on the temperature of cargo (70) within container (20).

Table 4 below contains data correlating with the chart of FIG. 12:

TABLE 4

| Hours | Center (° C.) | Ambient (° C.) | Side (° C.) | Corner (° C.) |
|---|---|---|---|---|
| 0.00 | 25.5 | 24.8 | 25.3 | 25.5 |
| 0.17 | 25.6 | 18.8 | 24.3 | 24 |
| 0.33 | 25.3 | 18.3 | 22.4 | 21.5 |
| 0.50 | 24.7 | 18.2 | 20.9 | 19.8 |
| 0.67 | 24.1 | 18.1 | 19.8 | 18.7 |
| 0.83 | 23.3 | 18.1 | 18.9 | 18 |
| 1.00 | 22.6 | 18.1 | 18.3 | 17.5 |
| 1.17 | 21.9 | 18.1 | 17.8 | 17.1 |
| 1.33 | 21.2 | 18.1 | 17.3 | 16.7 |
| 1.50 | 20.6 | 18.1 | 17 | 16.5 |
| 1.67 | 20 | 18 | 16.7 | 16.3 |
| 1.83 | 19.5 | 18 | 16.4 | 16.1 |
| 2.00 | 19.1 | 18 | 16.2 | 15.9 |
| 2.17 | 18.7 | 18 | 16 | 15.8 |
| 2.33 | 18.3 | 18 | 15.8 | 15.7 |
| 2.50 | 18 | 18 | 15.7 | 15.6 |
| 2.67 | 17.7 | 18 | 15.5 | 15.4 |
| 2.83 | 17.4 | 18 | 15.4 | 15.4 |
| 3.00 | 17.2 | 18 | 15.3 | 15.3 |
| 3.17 | 16.9 | 18 | 15.2 | 15.3 |
| 3.33 | 16.8 | 18 | 15.1 | 15.2 |
| 3.50 | 16.6 | 18 | 15.1 | 15.2 |
| 3.67 | 16.4 | 18.1 | 15 | 15.2 |
| 3.83 | 16.3 | 18 | 14.9 | 15.1 |
| 4.00 | 16.2 | 18 | 14.9 | 15.1 |
| 4.17 | 16.1 | 18.1 | 14.8 | 15.1 |
| 4.33 | 15.9 | 18 | 14.8 | 15.1 |
| 4.50 | 15.9 | 18.1 | 14.8 | 15.1 |
| 4.67 | 15.8 | 18 | 14.7 | 15 |
| 4.83 | 15.7 | 18.1 | 14.7 | 15 |
| 5.00 | 15.7 | 18 | 14.7 | 15 |
| 5.17 | 15.6 | 18.1 | 14.7 | 15 |
| 5.33 | 15.6 | 18 | 14.7 | 15 |
| 5.50 | 15.5 | 18 | 14.7 | 15 |
| 5.67 | 15.5 | 18.1 | 14.7 | 15 |
| 5.83 | 15.4 | 18 | 14.7 | 15 |
| 6.00 | 15.4 | 18 | 14.7 | 15 |
| 6.17 | 15.4 | 16.3 | 14.7 | 15.1 |
| 6.33 | 15.4 | 13.4 | 14.7 | 15.1 |
| 6.50 | 15.4 | 10.4 | 14.7 | 15.1 |
| 6.67 | 15.4 | 7.3 | 14.7 | 15.1 |
| 6.83 | 15.3 | 4.2 | 14.7 | 15 |
| 7.00 | 15.3 | 1.1 | 14.7 | 15 |
| 7.17 | 15.3 | −2.1 | 14.7 | 14.9 |
| 7.33 | 15.3 | −5.3 | 14.6 | 14.9 |
| 7.50 | 15.3 | −8.4 | 14.6 | 14.8 |
| 7.67 | 15.2 | −11.6 | 14.6 | 14.7 |
| 7.83 | 15.2 | −14.8 | 14.5 | 14.6 |
| 8.00 | 15.1 | −17.9 | 14.4 | 14.4 |
| 8.17 | 15 | −19.4 | 14.3 | 14.2 |
| 8.33 | 14.9 | −19.6 | 14.2 | 14 |
| 8.50 | 14.8 | −19.7 | 14 | 13.8 |
| 8.67 | 14.6 | −19.7 | 13.8 | 13.5 |
| 8.83 | 14.4 | −19.7 | 13.7 | 13.2 |
| 9.00 | 14.3 | −19.8 | 13.4 | 12.9 |
| 9.17 | 14.1 | −19.8 | 13.2 | 12.6 |
| 9.33 | 13.8 | −19.8 | 12.9 | 12.3 |
| 9.50 | 13.6 | −19.8 | 12.6 | 12 |
| 9.67 | 13.4 | −19.8 | 12.3 | 11.7 |
| 9.83 | 13.1 | −19.8 | 12 | 11.3 |
| 10.00 | 12.8 | −19.8 | 11.7 | 11 |
| 10.17 | 12.6 | −18.4 | 11.3 | 10.6 |
| 10.33 | 12.3 | −16.1 | 11 | 10.3 |
| 10.50 | 11.9 | −13.6 | 10.7 | 9.9 |
| 10.67 | 11.6 | −11.1 | 10.3 | 9.6 |
| 10.83 | 11.3 | −8.7 | 9.9 | 9.2 |
| 11.00 | 11 | −6.2 | 9.6 | 8.9 |
| 11.17 | 10.7 | −3.7 | 9.3 | 8.6 |
| 11.33 | 10.4 | −1.2 | 8.9 | 8.3 |
| 11.50 | 10.1 | 1.2 | 8.7 | 8.1 |
| 11.67 | 9.8 | 3.5 | 8.4 | 7.8 |

TABLE 4-continued

| Hours | Center (° C.) | Ambient (° C.) | Side (° C.) | Corner (° C.) |
|---|---|---|---|---|
| 11.83 | 9.5 | 5.9 | 8.1 | 7.6 |
| 12.00 | 9.2 | 8.4 | 7.9 | 7.4 |
| 12.17 | 9 | 9.6 | 7.7 | 7.3 |
| 12.33 | 8.8 | 9.8 | 7.4 | 7.2 |
| 12.30 | 8.6 | 9.9 | 7.3 | 7.1 |
| 12.67 | 8.4 | 10 | 7.2 | 7.1 |
| 12.83 | 8.2 | 10.1 | 7.1 | 7.1 |
| 13.00 | 8.1 | 10.1 | 7 | 7.1 |
| 13.17 | 7.9 | 10.1 | 6.9 | 7.1 |
| 13.33 | 7.8 | 10.1 | 6.9 | 7.1 |
| 13.50 | 7.8 | 10.1 | 6.9 | 7.1 |
| 13.67 | 7.7 | 10.1 | 6.9 | 7.2 |
| 13.83 | 7.7 | 10.1 | 6.9 | 7.2 |
| 14.00 | 7.6 | 10.1 | 6.9 | 7.2 |
| 14.17 | 7.6 | 10.1 | 6.9 | 7.3 |
| 14.33 | 7.6 | 10.1 | 6.9 | 7.3 |
| 14.50 | 7.6 | 10.1 | 6.9 | 7.4 |
| 14.67 | 7.6 | 10.1 | 6.9 | 7.4 |
| 14.83 | 7.6 | 10.1 | 7 | 7.4 |
| 15.00 | 7.6 | 10.1 | 7.1 | 7.5 |
| 15.17 | 7.6 | 10.1 | 7.1 | 7.6 |
| 15.33 | 7.7 | 10.1 | 7.1 | 7.6 |
| 15.50 | 7.7 | 10.1 | 7.2 | 7.7 |
| 15.67 | 7.7 | 10.1 | 7.2 | 7.7 |
| 15.83 | 7.8 | 10.1 | 7.2 | 7.7 |
| 16.00 | 7.8 | 10.1 | 7.3 | 7.8 |
| 16.17 | 7.8 | 10.1 | 7.3 | 7.8 |
| 16.33 | 7.9 | 10.1 | 7.4 | 7.9 |
| 16.50 | 7.9 | 10.1 | 7.4 | 7.9 |
| 16.67 | 7.9 | 10.1 | 7.4 | 7.9 |
| 16.83 | 7.9 | 10.1 | 7.5 | 8 |
| 17.00 | 8 | 10.1 | 7.6 | 8.1 |
| 17.17 | 8.1 | 10.1 | 7.6 | 8.1 |
| 17.33 | 8.1 | 10.1 | 7.7 | 8.1 |
| 17.50 | 8.1 | 10.1 | 7.7 | 8.2 |
| 17.67 | 8.2 | 10.1 | 7.7 | 8.2 |
| 17.83 | 8.2 | 10.1 | 7.7 | 8.2 |
| 18.00 | 8.2 | 10.1 | 7.8 | 8.3 |
| 18.17 | 8.3 | 8.6 | 7.8 | 8.3 |
| 18.33 | 8.3 | 6.3 | 7.8 | 8.3 |
| 18.50 | 8.3 | 3.9 | 7.9 | 8.3 |
| 18.67 | 8.3 | 1.5 | 7.9 | 8.4 |
| 18.83 | 8.4 | −0.9 | 7.9 | 8.4 |
| 19.00 | 8.4 | −3.4 | 7.9 | 8.3 |
| 19.17 | 8.4 | −6 | 8 | 8.3 |
| 19.33 | 8.4 | −8.5 | 8 | 8.3 |
| 19.50 | 8.4 | −11 | 7.9 | 8.2 |
| 19.67 | 8.4 | −13.5 | 7.9 | 8.1 |
| 19.83 | 8.4 | −16 | 7.8 | 7.9 |
| 20.00 | 8.3 | −18.5 | 7.7 | 7.7 |
| 20.17 | 8.2 | −19.5 | 7.6 | 7.5 |
| 20.33 | 8.2 | −19.7 | 7.4 | 7.2 |
| 20.50 | 8 | −19.8 | 7.2 | 6.9 |
| 20.67 | 7.9 | −19.8 | 7 | 6.7 |
| 20.83 | 7.7 | −19.8 | 6.7 | 6.4 |
| 21.00 | 7.5 | −19.8 | 6.4 | 6.1 |
| 21.17 | 7.3 | −19.8 | 6.2 | 5.7 |
| 21.33 | 7.1 | −19.8 | 5.8 | 5.4 |
| 21.50 | 6.8 | −19.8 | 5.6 | 5.2 |
| 21.67 | 6.6 | −19.8 | 5.3 | 4.9 |
| 21.83 | 6.3 | −19.9 | 5.1 | 4.8 |
| 22.00 | 6.1 | −20 | 4.8 | 4.6 |
| 22.17 | 5.8 | −18.5 | 4.6 | 4.4 |
| 22.33 | 5.6 | −16.2 | 4.4 | 4.3 |
| 22.50 | 5.4 | −13.7 | 4.3 | 4.2 |
| 22.67 | 5.2 | −11.2 | 4.2 | 4.1 |
| 22.83 | 4.9 | −8.8 | 4.1 | 4.1 |
| 23.00 | 4.8 | −6.3 | 4.1 | 4 |
| 23.17 | 4.6 | −3.9 | 4 | 4 |
| 23.33 | 4.4 | −1.4 | 3.9 | 3.9 |
| 23.50 | 4.3 | 1.1 | 3.9 | 3.9 |
| 23.67 | 4.2 | 3.4 | 3.9 | 3.9 |
| 23.83 | 4.1 | 5.8 | 3.8 | 3.9 |
| 24.00 | 4.1 | 9.1 | 3.8 | 3.9 |

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, geometries, materials, dimensions, ratios, steps, and the like discussed above are illustrative and are not required. Accordingly, the scope of the present invention should be considered in terms of the following claims and is understood not to be limited to the details of structure and operation shown and described in the specification and drawings.

We claim:

1. An apparatus for controlling a thermal condition of cargo contained within a hollow interior of a cargo container, the apparatus comprising:

(a) at least one belt assembly, wherein the at least one belt assembly is configured to be received within the hollow interior of the cargo container, wherein the at least one belt assembly comprises at least three pouches, wherein each pouch defines a hollow interior and wherein the pouches are consecutively hingedly secured together in a series such that each pouch is operable to pivot toward and away from at least one adjoining pouch, wherein a first pouch of the at least three pouches comprises a cover configured to selectively cover and uncover a respective hollow interior; and (b) at least one phase-changing material pack comprising a flexible film material filled with a phase-changing material, wherein at least one pouch of the at least one belt assembly is configured to receive the at least one phase-changing material pack.

2. The apparatus of claim 1, wherein the at least one phase-changing material pack comprises a first phase-changing material pack and a second phase-changing material pack.

3. The apparatus of claim 2, wherein the first phase-changing material pack comprises a first phase-changing material and wherein the second phase-changing material pack comprises a second phase-changing material.

4. The apparatus of claim 3, wherein the first phase-changing material has a first melting point and wherein the second phase-changing material has a second melting point.

5. The apparatus of claim 3, wherein the first phase-changing material and the second phase-changing material have the same melting point.

6. The apparatus of claim 2, wherein the at least one belt assembly comprises a first belt assembly and a second belt assembly.

7. The apparatus of claim 6, wherein an at least one pouch of the first belt assembly is configured to receive at least one of the first phase-changing material pack and wherein an at least one pouch of the second belt assembly is configured to receive at least one of the second phase-changing material pack.

8. The apparatus of claim 6, wherein the first belt assembly and the second belt assembly are configured to provide for proper orientation of the first belt assembly and the second belt assembly relative one another within the cargo container.

9. The apparatus of claim 2, wherein the at least one pouch of the at least one belt assembly is configured to receive at least one of the first phase-changing material pack and at least one of the second phase-changing material pack.

10. A belt assembly, the belt assembly comprising:

(a) a plurality of pouches consecutively hingedly secured together in a series such that each pouch is operable to pivot toward and away from at least one neighboring pouch, wherein each pouch defines a hollow interior and wherein each pouch comprises a material and a cover, wherein the cover is configured to move between a covered position and an uncovered position relative to a respective hollow interior; and (b) at least one phase-changing material pack comprising a phase-changing material, wherein each pouch is configured to receive a respective phase-changing material pack of the at least one phase-changing material pack when the respective cover is in the uncovered position, wherein each pouch is configured to house the respective phase-changing material pack of the at least one phase-changing material pack when the respective cover is in the covered position.

11. A method of controlling a thermal condition of cargo within a container assembly, wherein the container assembly comprises an insulated container configured to receive the cargo, at least one belt assembly according to claim 10, wherein the belt assembly is configured to be received within the hollow interior of the insulated container, and at least one belt assembly according to claim 10, the method comprising the steps of:

(a) placing the at least one phase-changing material pack within the at least one pouch of the at least one belt assembly;

(b) conditioning the at least one phase-changing material pack by placing the at least one belt assembly within a thermal conditioning apparatus;

(c) folding the at least one belt assembly such that the at least three pouches are pivoted relative to at least one adjoining pouch;

(d) packing the at least one belt assembly within the hollow interior of the insulated container such that the at least one belt assembly defines an interior cavity within the hollow interior of the insulated container; and (e) packing the cargo within the interior cavity.

12. The method of claim 11, wherein the at least one belt assembly comprises at least a first belt assembly having at least one pouch and a second belt assembly having at least one pouch, wherein the at least one phase-changing material pack comprises a first phase-changing material pack and a second phase-changing material pack, the method further comprising the steps of:

(a) placing the first phase-changing material pack within the at least one pouch of the first belt assembly;

(b) placing the second phase-changing material pack within the at least one pouch of the second belt assembly; and (c) orienting the first belt assembly and the second belt assembly within the hollow interior of the insulated container.

13. An apparatus for controlling a thermal condition of cargo contained within a cargo container, wherein a body of the cargo container defines a hollow interior, the apparatus comprising:

(a) at least one belt assembly, wherein the at least one belt assembly is configured to be received within the hollow interior of the body of the cargo container, wherein the at least one belt assembly comprises at least three pouches, wherein each pouch of the at least three pouches comprises a cover and defines a hollow interior, wherein the pouches are consecutively hingedly secured together in a series such that each pouch is operable to pivot toward and away from at least one adjoining pouch, wherein each cover is configured to move between a covered position and an uncovered position; and (b) at least one phase-changing material pack comprising a film material housing a phase-changing material, wherein at least one pouch of the at least one belt assembly is configured to receive the at least one phase-changing material pack while the cover is in the uncovered position.

14. The apparatus of claim 13, wherein each cover is configured to bend relative to the other covers of each pouch of the at least three pouches.

15. The apparatus of 13, wherein the at least one belt assembly comprises nylon.

16. The apparatus of claim 13, wherein the at least one belt assembly comprises a waterproof material.

17. The apparatus of claim 13, wherein each cover is configured to move between the covered position and the uncovered position relative to the other covers of each pouch of the at least three pouches.

* * * * *